US011548298B2

(12) United States Patent
Kitahara

(10) Patent No.: US 11,548,298 B2
(45) Date of Patent: Jan. 10, 2023

(54) RECORDING DEVICE AND CONTROL METHOD FOR RECORDING DEVICE

(71) Applicant: SEIKO EPSON CORPORATION, Tokyo (JP)

(72) Inventor: Keisuke Kitahara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/447,475

(22) Filed: Sep. 13, 2021

(65) Prior Publication Data

US 2022/0080753 A1 Mar. 17, 2022

(30) Foreign Application Priority Data

Sep. 15, 2020 (JP) ..... JP2020-154426

(51) Int. Cl.
*B41J 13/00* (2006.01)
*B41J 11/42* (2006.01)

(52) U.S. Cl.
CPC ..... *B41J 11/42* (2013.01); *B41J 13/0009* (2013.01)

(58) Field of Classification Search
CPC . B41J 11/0005; B41J 11/0035; B41J 11/0045; B41J 11/006; B41J 11/42; B41J 11/0027; B41J 13/0009; B41J 13/0027; B41J 13/0036; B41J 13/009; B41J 13/02; B41J 13/025; B41J 13/10; B41J 13/106
See application file for complete search history.

(56) References Cited

U.S. PATENT DOCUMENTS

2017/0282609 A1* 10/2017 Yatsunami ..... B65H 5/062
2018/0345688 A1* 12/2018 Shomura ..... B65H 5/068
2020/0239252 A1* 7/2020 Komuro ..... B41J 13/0045

FOREIGN PATENT DOCUMENTS

JP 2007-144960 A 6/2007

* cited by examiner

*Primary Examiner* — Scott A Richmond
(74) *Attorney, Agent, or Firm* — Workman Nydegger

(57) ABSTRACT

A recording device includes a recording unit, a support unit, a roller pair downstream of the recording unit and configured to transport the medium, a plurality of regulating members disposed between the recording unit and the roller pair and configured to touch the medium from above, and an inversion path configured to invert front-to-back the medium on which recording was performed and to merge upstream of the recording unit, where a nip point of the roller pair is positioned higher than the support face, a bottom end of each regulating member is disposed at a position for pushing the medium down lower than the nip point of the roller pair and of the plurality of regulating members, the regulating members disposed at both end portion sides in the width direction apply less load on the medium than the regulating member disposed toward a center in the width direction.

12 Claims, 20 Drawing Sheets

RECORDING DEVICE AND CONTROL METHOD FOR RECORDING DEVICE

The present application is based on, and claims priority from JP Application Serial Number 2020-154426, filed Sep. 15, 2020, the disclosure of which is hereby incorporated by reference herein in its entirety.

BACKGROUND

1. Technical Field

The present disclosure relates to a recording device and a control method for a recording device.

2. Related Art

Conventionally, as illustrated in JP-A-2007-144960, an inkjet recording device capable of double-sided printing is known that includes a recording head dispensing ink onto a medium to create an image and a unit that inverts front-to-back a recording medium having a recording and re-feeds the recording medium to the recording head.

In this case, for example, when using a recording medium having greater rigidity than ordinary paper (for example, photograph paper), a situation may arise where, when ink is applied to one surface of the recording medium, the recording medium swells due to moisture in the ink and the recording medium holds a curved shape that is convex toward the recording head.

In addition, when the curved recording medium is inverted front-to-back and is re-fed to the recording head, the recording medium is fed in a state curved in a downwardly convex shape. Therefore, the recording medium may make contact with the recording head. In particular, while printing on a reverse face, a rear end of the recording medium frequently escapes from a nip point of an upstream transport roller upstream of the recording head, after which the rear end of the recording medium makes contact with the recording head.

When the recording medium makes contact with and rubs against the recording head, ink adheres to the recording medium and image quality degrades.

SUMMARY

A recording device includes a recording unit configured to dispense a liquid onto a medium to perform recording, a support unit disposed facing the recording unit and configured to support the medium at a support face, a downstream transport roller pair disposed in plurality along a width direction intersecting a transport direction of the medium and downstream of the recording unit in the transport direction of the medium and configured to transport the medium, a regulating member disposed in plurality along the width direction of the medium between the recording unit and the downstream transport roller pair in the transport direction and configured to touch the medium from above, and an inversion path configured to invert front-to-back the medium on which recording was performed on a first surface of the medium and to merge upstream of the recording unit so as to achieve recording on a second surface of the medium opposite from the first surface, where a nip point of the downstream transport roller pair is positioned higher than the support face and a bottom end of each regulating member is disposed at a position for pushing the medium down lower than the nip point of the downstream transport roller pair, and of the plurality of regulating members, the regulating members disposed at both end portion sides in the width direction apply less load on the medium than the regulating member disposed toward a center in the width direction.

A control method for a recording device including a recording unit configured to dispense a liquid onto a medium to perform recording, a support unit disposed facing the recording unit and configured to support the medium, a downstream transport roller pair disposed in plurality along a width direction of the medium and downstream of the recording unit in a transport direction of the medium and configured to transport the medium, a regulating member disposed in plurality along the width direction of the medium between the recording unit and the downstream transport roller pair in the transport direction of the medium and configured to touch the medium from above, an inversion path configured to invert front-to-back the medium on which recording was performed on a first surface of the medium and to merge upstream of the recording unit so as to achieve recording on a second surface of the medium opposite from the first surface, a position adjustment mechanism configured to change a position in a vertical-direction of the regulating members disposed at both end portion sides in the width direction, and a control unit, where the control unit controls the position adjustment mechanism and causes the regulating members disposed at both end portion sides in the width direction, of the plurality of regulating members, to apply less load on the medium than the regulating member disposed toward a center.

DESCRIPTION OF EXEMPLARY EMBODIMENTS

1. First Embodiment

First, a configuration of a recording device 11 will be described. The recording device 11 according to the present embodiment is an inkjet recording device dispensing ink as a liquid onto a medium M to print. As examples of the medium M, the recording device 11 according to the embodiment is configured to be capable of printing on a cut-sheet medium and on a long medium that is wound into a roll.

In the following drawings, the recording device 11 is treated as being in a state placed on a horizontal plane. As directions on the horizontal plane, the drawings treat a front-back direction of the recording device 11 as a direction along an X axis and a left-right direction (width direction, intersecting with a transport direction) as a direction along a Y axis. Furthermore, a direction vertical (up-down direction) to the horizontal plane is treated as a direction along a Z axis. In addition, a +X direction is treated as a forward direction, a −X direction as a backward direction, a +Y direction as a right direction, a −Y direction as a left direction, a +Z direction as an upward direction and a −Z direction as a downward direction.

Figure 1:
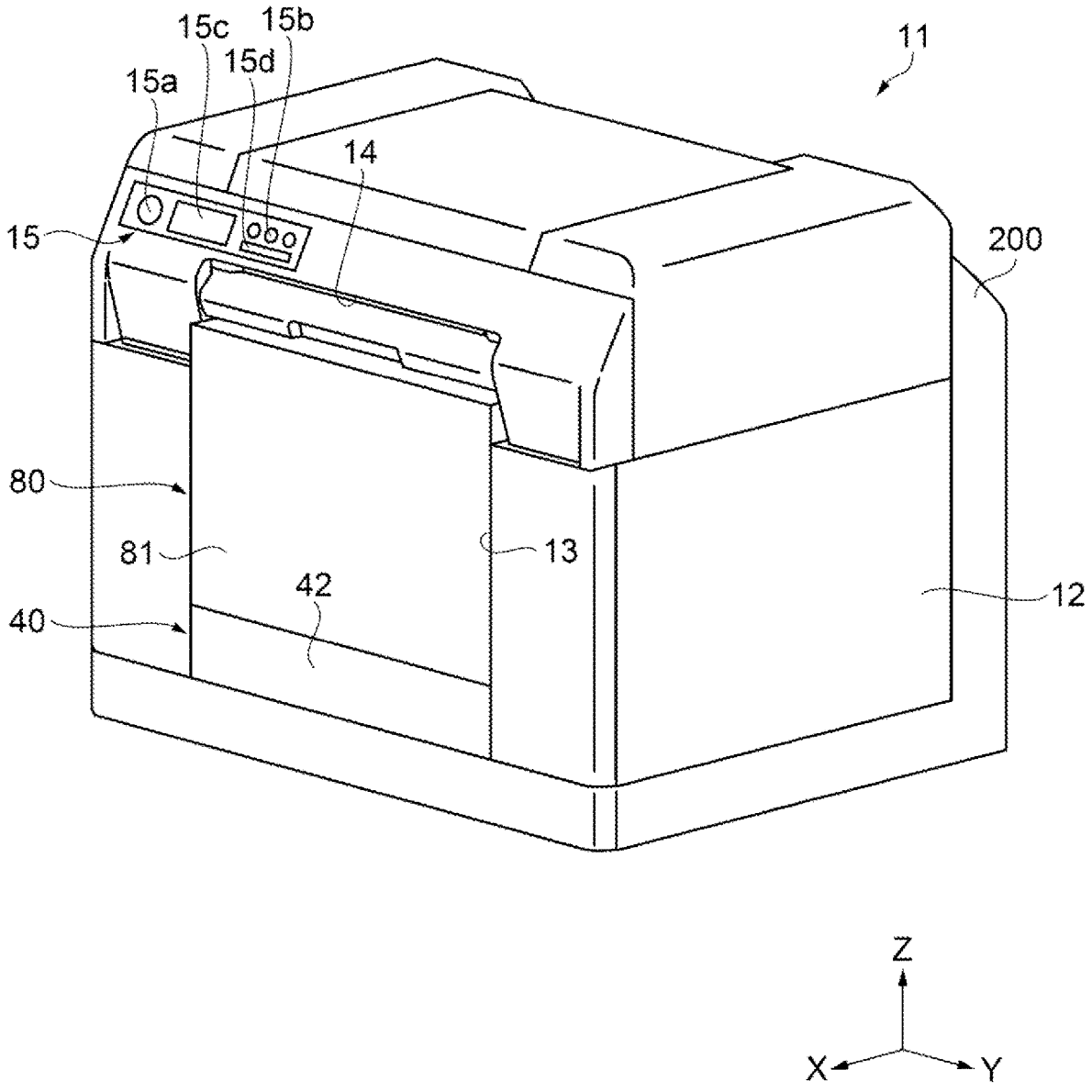
FIG. 1 is a perspective view illustrating an external configuration of a recording device according to a first embodiment.
Figure 2:
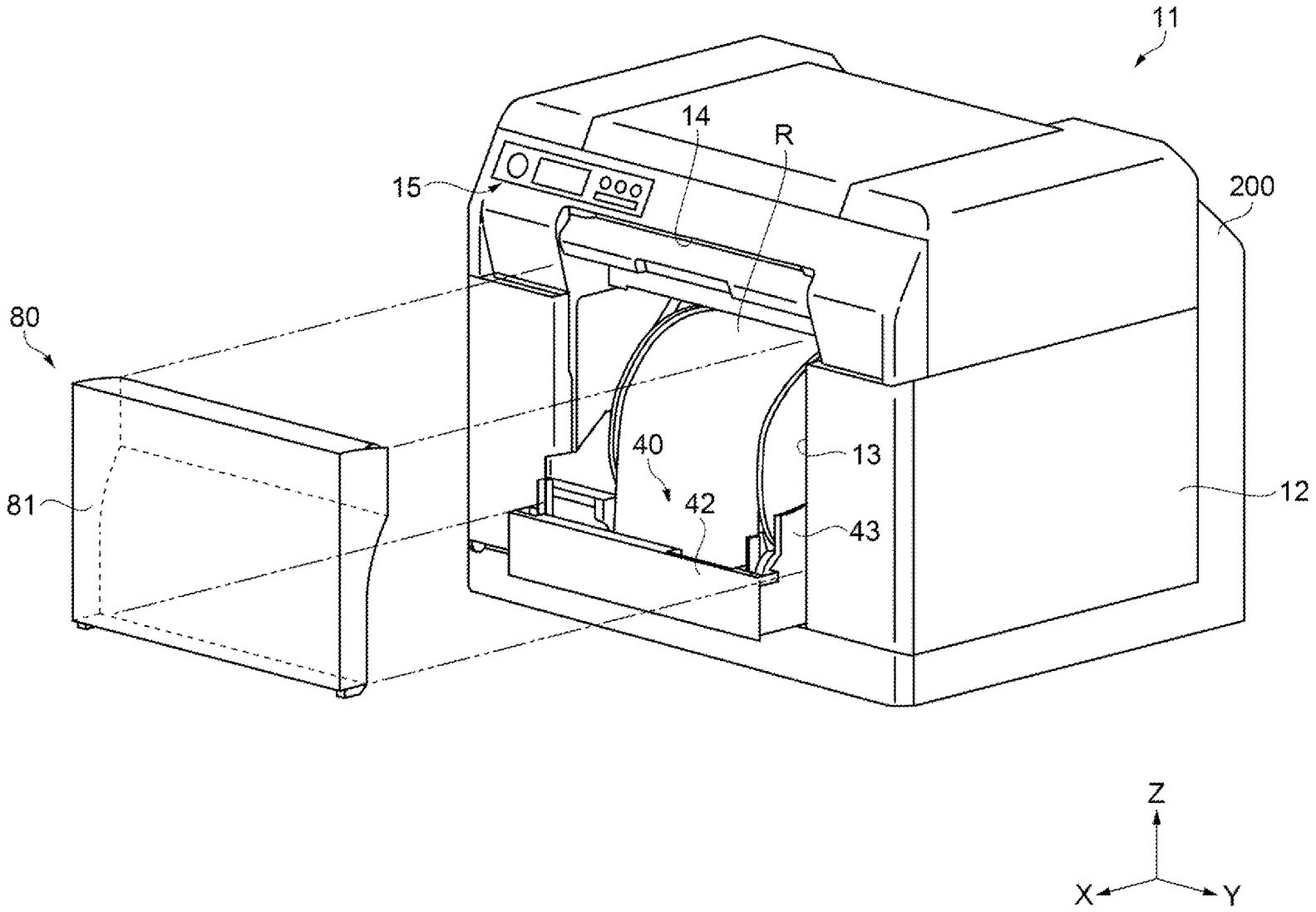
FIG. 2 is a perspective view illustrating an external configuration of the recording device according to the first embodiment.
Figure 3:
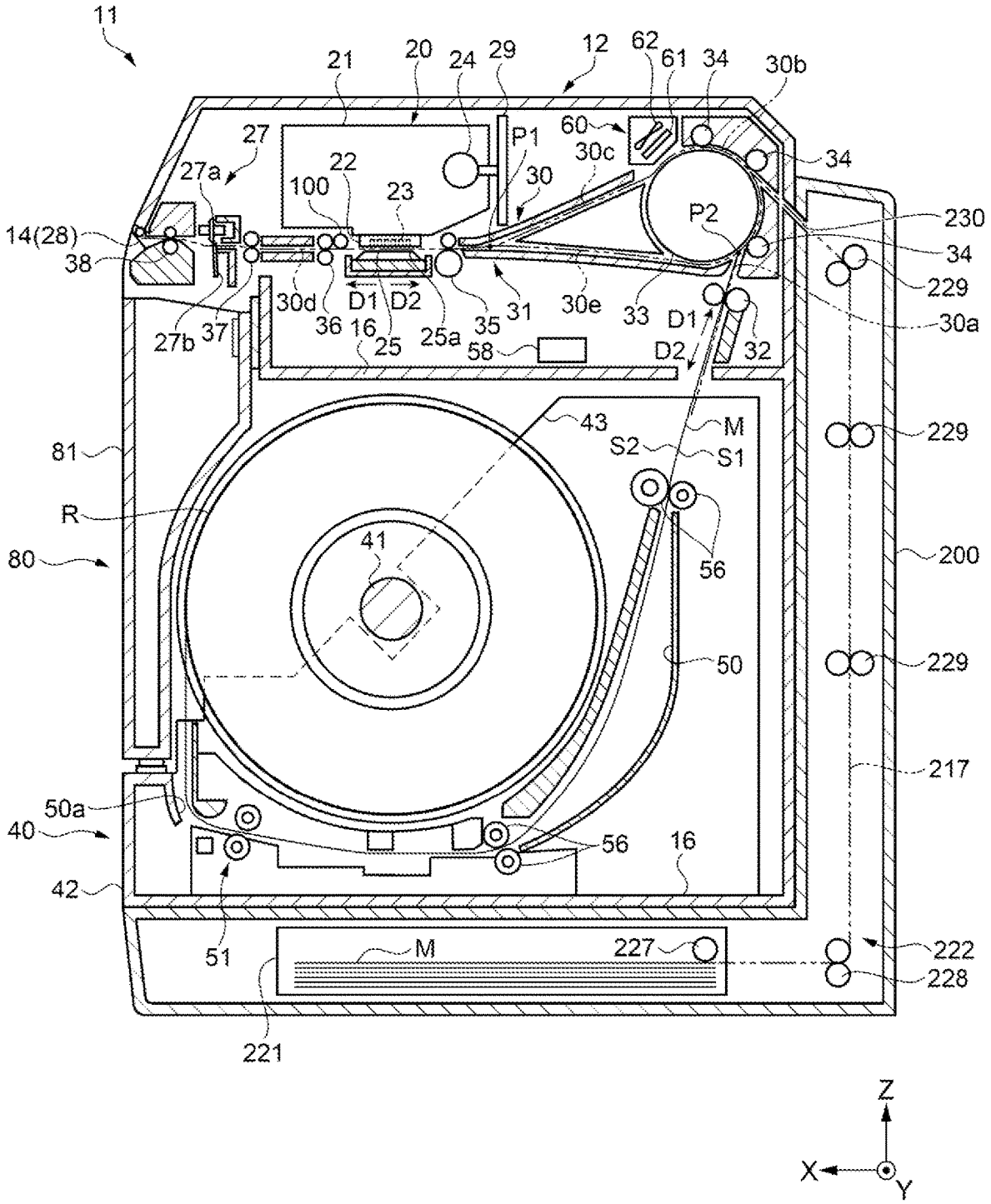
FIG. 3 is a cross-sectional schematic view illustrating an internal configuration of the recording device according to the first embodiment.

As illustrated in FIG. 1, FIG. 2 and FIG. 3, the recording device 11 includes a cuboid housing 12 and a body frame 16 that supports portions of the recording device 11. The housing 12 includes an opening portion 13 opening to a front face. In addition, a discharge port 14 discharging the recorded (printed) and cut medium M is installed in the housing 12. Note that the discharge port 14 constitutes a discharge unit 28.

The recording device 11 includes a storage unit 40 that stores the roll paper R and also feeds out the stored roll paper R. The storage unit 40 is installed such that the storage unit 40 can be pulled from the housing 12 through the opening portion 13 in the forward direction. The storage unit 40 includes a front plate portion 42 that, when stored in the housing 12, constitutes part of the outer packaging of the recording device 11 and a pair of support walls 43 rotatably supporting the roll paper R.

Below the discharge unit 28, a box-shaped cutting waste accommodation unit 80 is provided accommodating cutting waste of the medium M produced by cutting performed by a cutting unit 27. The cutting waste accommodation unit 80 is detachably installed on the front face of the housing 12, forward of the roll paper R. The cutting waste accommodation unit 80 is attached to the housing 12, sealing the opening portion 13. The cutting waste accommodation unit 80 includes an outer wall 81 that, when attached to the housing 12, constitutes part of the outer packaging of the recording device 11.

When the cutting waste accommodation unit 80 is detached from the housing 12, the storage unit 40 can be pulled out of the housing 12. With the storage unit 40 pulled out of the housing 12, the roll paper R is replaced.

Further, an operation unit 15 for operating the recording device 11 is provided on the front of the housing 12. The operation unit 15 is a panel that is long in the direction along the Y axis and is provided with a power button 15*a* operated when turning the recording device 11 on or off, an input button 15*b* capable of inputting various types of operation information and an operation panel 15*c* provided with a display of an operation status of the recording device 11, for example, or an operation button for the recording device 11. The operation panel 15*c* is a touchscreen panel. Additionally, a speaker 15*d* is provided emitting sound to an exterior.

As illustrated in FIG. 3, the recording device 11 includes a transport path 30 (illustrated by a double dot dashed line in the drawing) on which the medium M is transported. The recording device 11 includes a transport unit 31 transporting the medium M along the transport path 30, a recording unit 20 recording on the medium M and the cutting unit 27 cutting the medium M.

The recording unit 20 records on the medium M transported from the storage unit 40. The recording unit 20 includes a head 22 having a nozzle 23 dispensing ink toward the medium M and a carriage 21 on which the head 22 is mounted. The carriage 21 is supported by a guide frame 29 extending along the Y axis and a guide shaft 24 attached to the guide frame 29 and extending along the Y axis. The carriage 21 is movable along the guide shaft 24 with a drive source such as a motor. That is, the carriage 21 is capable of reciprocating in a direction along the Y axis. A support unit 25 supporting the medium M is provided at a position opposite the head 22.

By dispensing ink while reciprocating together with the carriage 21 in a width direction of the medium M, the head 22 records on the medium M supported by a support face 25*a* of the support unit 25. In the present embodiment, a serial head-type recording unit in which the head 22 reciprocates in the width direction was given as an example of the recording unit 20, but the recording unit 20 may be a line head-type recording unit in which the head 22 is fixedly arranged extending in the width direction.

The transport path 30 is a space in which the medium M can move and is configured by a plurality of members. The transport path 30 runs from the storage unit 40 located furthest upstream and feeding out the roll paper R, to the discharge unit 28 (discharge port 14) located furthest downstream. The recording unit 20, the support unit 25 and the like are disposed on the transport path 30.

The cutting unit 27 is located downstream from the support unit 25 and upstream from the discharge port 14. The cutting unit 27 of the present embodiment includes a movable blade 27*a* capable of reciprocating in the width direction and a fixed blade 27*b* that does not move. The movable blade 27*a* is provided above the transport path 30 and the fixed blade 27*b* is provided below the transport path 30. The cutting unit 27 cuts the medium M at a cutting position across the width direction. The cutting position is the position of a blade edge of the fixed blade 27*b*.

The transport path 30 of the embodiment includes, from upstream in the transport direction of the medium M, a first path 30*a* on which the medium M fed out from the roll paper R is transported, a curved path 30*b* on which the medium M is transported while curving, a second path 30*c* on which the medium M is transported toward the head 22 (support unit 25) and a third path 30*d* on which the medium M is transported from downstream of the support unit 25 toward the discharge unit 28.

Furthermore, the transport path 30 includes an inversion path 30*e*. The inversion path 30*e* is a passage connecting a branch point P1 branching from the second path 30*c* and a merge point P2 where the inversion path 30*e* merges into the first path 30*a*. In the transport direction of the medium M transported via the curved path 30*b*, the merge point P2 is located upstream from the branch point P1. That is, the inversion path 30*e* merges upstream of the curved path 30*b*. The inversion path 30*e* is a path for inverting a cut-sheet medium M and recording on both surfaces of the medium M.

The transport unit 31 transports the medium M along the transport path 30 from the storage unit 40, past the recording unit 20, to the cutting unit 27 and the discharge unit 28. The transport unit 31 includes a feed roller pair 32 provided on the first path 30*a*, a middle roller 33 forming the curved path 30*b*, a driven roller 34 disposed along an outer circumferential surface of the middle roller 33 on the curved path 30*b* and an upstream transport roller pair 35 provided on the second path 30*c*.

The driven roller 34 is provided so as to freely rotate and is driven to rotate with the medium M between the driven roller 34 and the middle roller 33. In the embodiment, a plurality of driven rollers 34 (three in the embodiment) is provided. Accordingly, the inverted medium M can be smoothly transported along the curved path 30*b*.

The transport unit 31 further includes, on the third path 30*d*, a downstream first transport roller pair 36 (corresponds to a downstream transport roller pair), a downstream second transport roller pair 37 and a downstream third transport roller pair 38. The downstream second transport roller pair 37 is located upstream from the cutting unit 27. The downstream third transport roller pair 38 is located downstream from the cutting unit 27.

Here, a configuration of the storage unit 40 will be described.

The storage unit 40 has the roll paper R rotatably supported via a support shaft 41 extending in a width direction of the housing 12. The support shaft 41 is configured to be capable of rotational drive in both forward and reverse directions. Thus, the roll paper R is driven to rotate in both the forward and reverse directions via the support shaft 41. Furthermore, the storage unit 40 is provided with a roll paper transport track 50 for transporting the medium M fed out from the roll paper R toward the first path 30*a*. The roll paper transport track 50 is part of the transport path 30.

The roll paper transport track 50 extends downward from a front side of the roll paper R that is supported via the support shaft 41 and then bends in the backward direction, goes around the downward direction and backward direction of the roll paper R and extends to a position higher than the roll paper R, moving in the upward direction to the first path 30*a*.

The roll paper transport track 50 has a bent portion 50*a* bending at substantially a right angle at an upstream end portion of the roll paper transport track 50, that is, at a position forward and diagonally downward of the roll paper R on the roll paper transport track 50. A decurling mechanism 51 is provided downstream of the bent portion 50*a* of the roll paper transport track 50, the decurling mechanism 51 performing decurling that corrects roll memory of the medium M fed out from the roll paper R.

Downstream from the decurling mechanism 51 on the roll paper transport track 50, a roll paper transport roller pair 56 imparting transport force to the roll paper R is installed with suitable spacing. When the roll paper transport roller pair 56 drives and rotates, the medium M is fed out from the roll paper R and transported to the first path 30*a*. The roll paper transport roller pair 56 is part of the transport unit 31.

The roll paper transport roller pair 56, the feed roller pair 32, the middle roller 33, the driven roller 34, the upstream transport roller pair 35, the downstream first transport roller pair 36, the downstream second transport roller pair 37 and the downstream third transport roller pair 38 transport the medium M by rotating in a state where the medium M is between the rollers.

When the roller pairs of the transport unit 31 are driven to rotate forward, the medium M is transported from upstream to downstream. On the other hand, when the roller pairs of the transport unit 31 are driven to rotate in reverse, the medium M is transported from downstream to upstream. In the embodiment, the direction going downstream along the transport path 30 is referred to as a progressive feeding direction D1 (corresponding to the transport direction) and the direction going upstream is referred to as a reverse feeding direction D2.

In addition, the recording device 11 has a regulating member 100 disposed, in the transport direction (progressive feeding direction D1), between the recording unit 20 and the downstream first transport roller pair 36. The regulating member 100 is a component that touches the medium M from above. Details of the configuration of the regulating member 100 will be described hereafter.

The recording device 11 includes a heating unit 60 heating the transported medium M. The heating unit 60 is positioned facing the middle roller 33 installed on the curved path 30*b*. The heating unit 60 is installed immediately downstream of the furthest downstream driven roller 34 among the three driven rollers 34. The heating unit 60 is configured to correct a curl memory of the medium M. The heating unit 60 of the embodiment includes a heater 61 generating heat and a fan 62 blowing the heat generated by the heater 61 onto the medium M.

In addition, the recording device 11 includes an accommodating carrier 200 accommodating a cassette 221 that accommodates the cut-sheet medium M. The accommodating carrier 200 is capable of transporting the medium M. The accommodating carrier 200 is configured to be detachable from the housing 12.

The accommodating carrier 200 has a feeding unit 222 transporting the medium M accommodated in the cassette 221 toward the curved path 30*b*.

The feeding unit 222 includes a pickup roller 227 feeding out the topmost medium M of the mediums M accommodated in a stacked state in the cassette 221, a separating roller pair 228 separating the medium M fed out by the pickup roller 227 into one sheet at a time and a transport roller pair 229 transporting the medium M along a cut-sheet transport path 217 toward the curved path 30*b*.

On a downstream end of the cut-sheet transport path 217, a communicating passage 230 is provided communicating with the curved path 30*b*.

The medium M transported from the cassette 221 is transported along the cut-sheet transport path 217 and merges into the curved path 30*b* via the communicating passage 230. The medium M that has merged into the curved path 30*b* is transported toward the recording unit 20 by the transport unit 31 and the recording unit 20 performs recording on the medium M.

Next, a configuration of the control unit 58 of the recording device 11 will be described.

Figure 4:
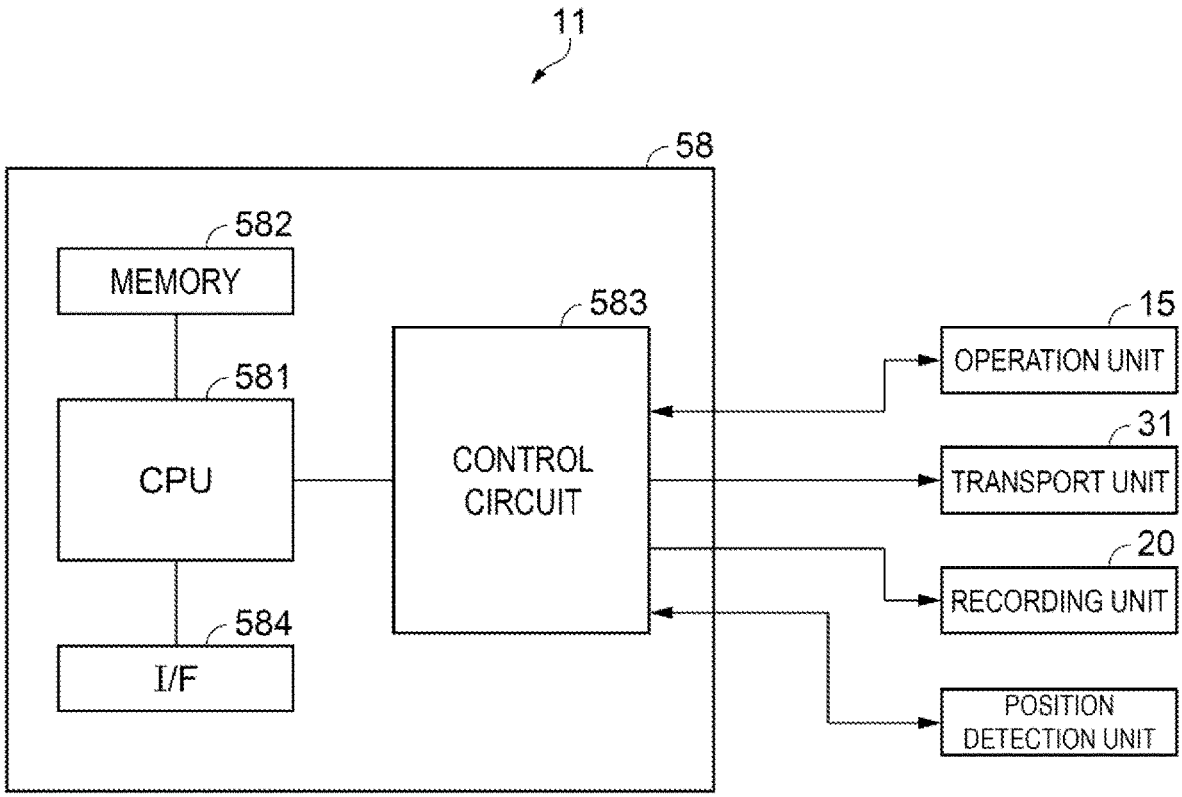
FIG. 4 is a block diagram illustrating a configuration of a control unit of the recording device according to the first embodiment.

The recording device 11 includes the control unit 58 controlling various operations performed by the recording device 11. As illustrated in FIG. 4, the control unit 58 includes a CPU 581, a memory 582, a control circuit 583 and an interface (I/F) 584. The CPU 581 is an arithmetic processing device. The memory 582 is a storage device ensuring a region for storing programs of the CPU 581, a working region and the like and includes a storage element such as a RAM or EEPROM. When recording data and the like is acquired from outside an information processing terminal or the like via the I/F 584, the CPU 581 controls various drive units and the like.

Note that the control unit 58 is configured to be capable of drive controlling each of the feed roller pair 32, the middle roller 33, the upstream transport roller pair 35, the downstream first transport roller pair 36, the downstream second transport roller pair 37, the downstream third transport roller pair 38, the roll paper transport roller pair 56, the pickup roller 227, the separating roller pair 228 and the transport roller pair 229 constituting the transport unit 31.

In addition, a transport position of the medium M is configured to be detectable by a position detection unit. The position detection unit is, for example, an optical sensor disposed on the transport path 30 and includes a light emitting unit capable of emitting light and a light receiving unit capable of receiving light. The light emitting unit emits light downward of the optical sensor and the light receiving unit receives reflected light reflected by the medium M. The light emitting unit is configured by a light emitting diode (LED), a laser light emitting element and the like. In addition, the light receiving unit is configured by a phototransistor, a photo IC and the like. The light receiving unit acquires a received amount of received light as a voltage value. Additionally, the amount of received light (voltage value) includes a threshold value for determining the presence or absence of the medium M, and the presence or absence of the medium M is determined based on the threshold value. This enables detection of an end portion of the medium M. The control unit 58 drive controls the transport unit 31 based on detection information from the position detection unit. Note that the position detection unit may be a rotary encoder that can be disposed at each driving roller.

Next, a control method will be described for double-sided printing on the cut-sheet medium M.

FIG. 5A to FIG. 5E are schematic views illustrating the control method for the recording device 11. Note that a first surface S1 of the medium M is a downward surface when the medium M is accommodated in the cassette 221. On the other hand, a second surface S2 of the medium M is an upper surface when the medium M is accommodated in the cassette 221.

Figure 5A:
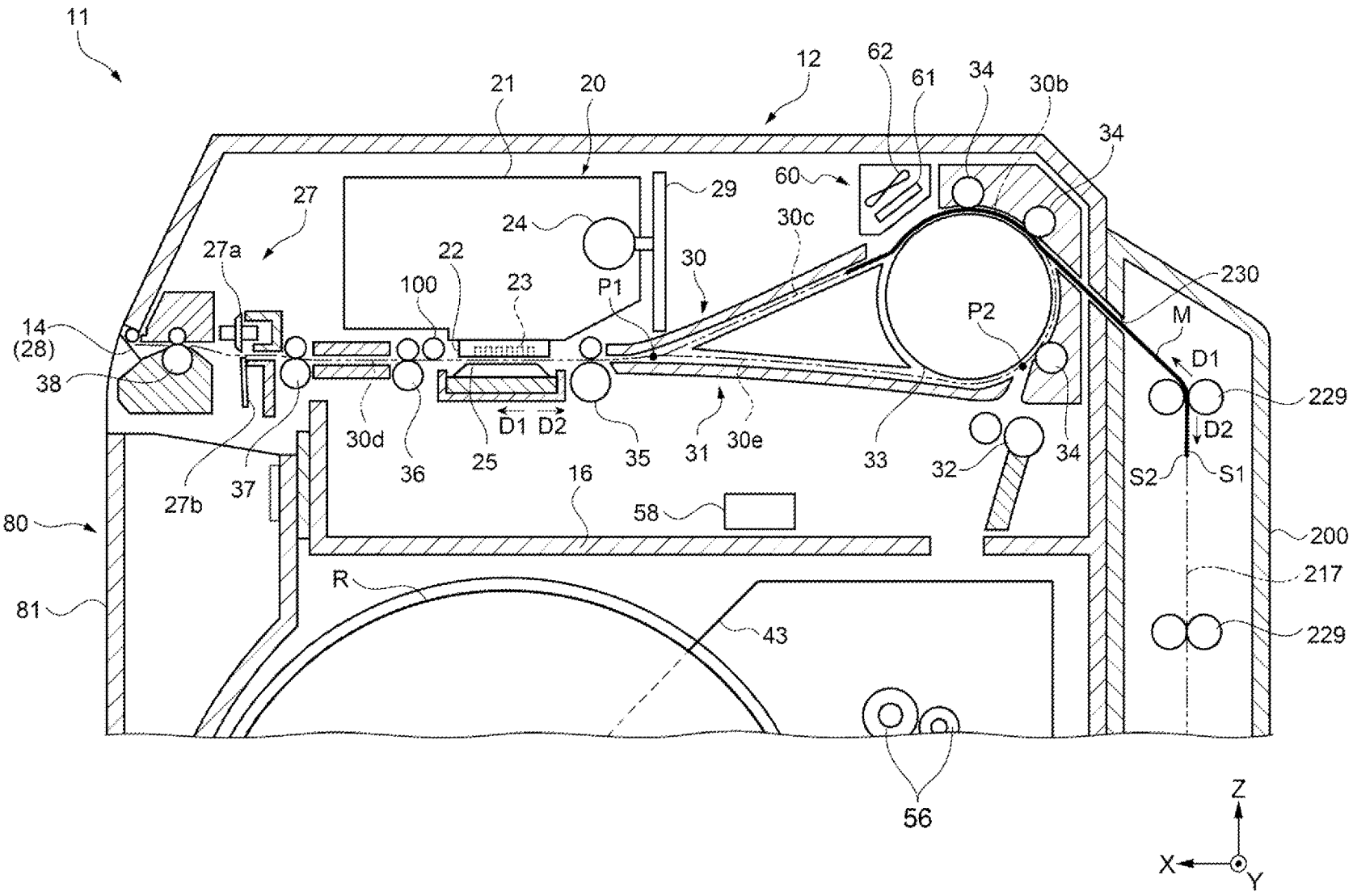
FIG. 5A is a schematic view illustrating a control method for the recording device according to the first embodiment.

First, as illustrated in FIG. 5A, the control unit 58 drives the transport unit 31 to rotate forward and transports the medium M accommodated in the cassette 221 in the progressive feeding direction D1 of the cut-sheet transport path 217. The medium M is transported from the cut-sheet transport path 217 and through the communicating passage 230 to merge with the curved path 30*b*, and is further transported through the second path 30*c* toward the head 22.

Figure 5B:
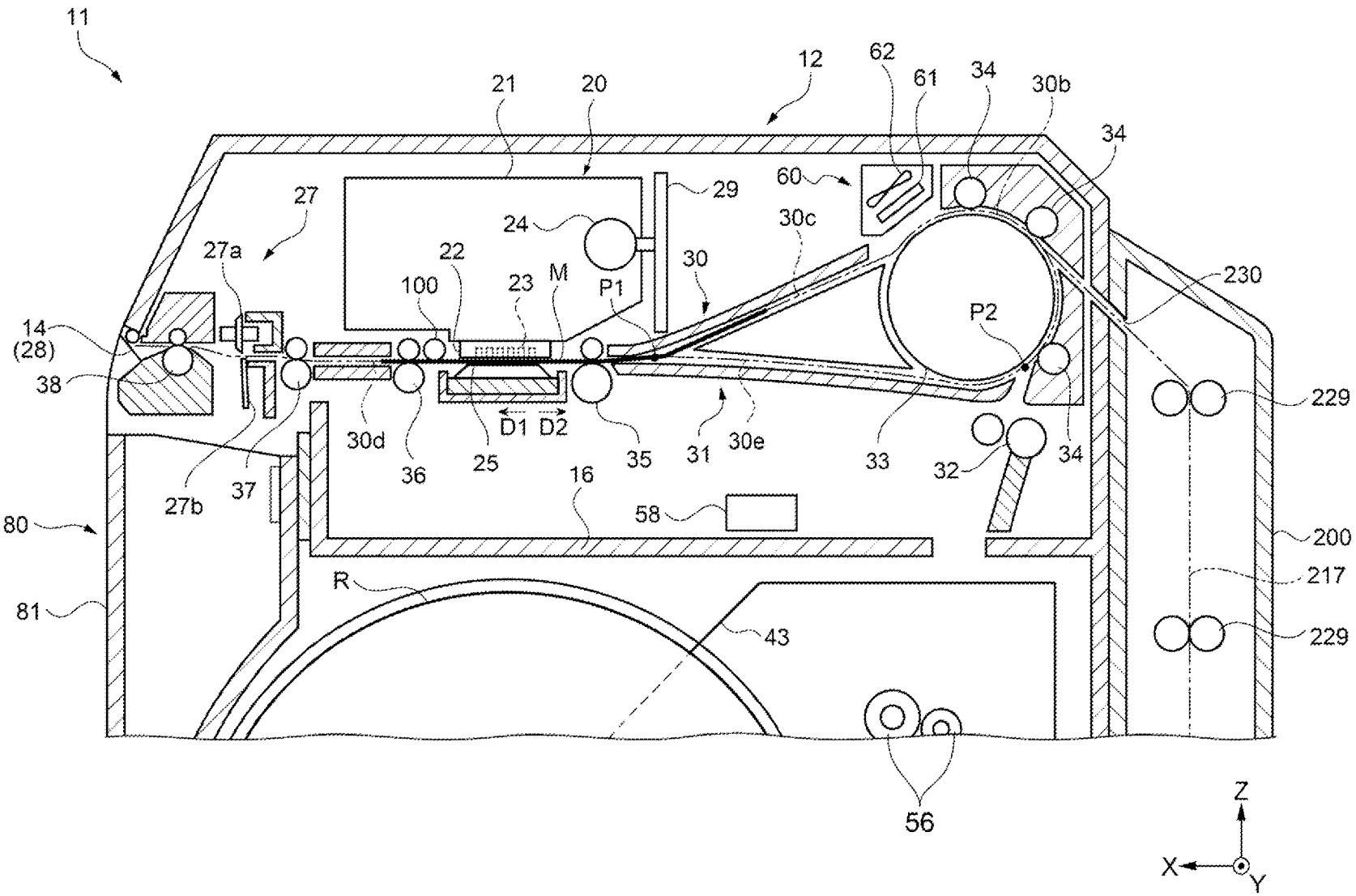
FIG. 5B is a schematic view illustrating the control method for the recording device according to the first embodiment.

Next, as illustrated in FIG. 5B, the control unit 58 drives the recording unit 20 while driving the transport unit 31 to rotate forward, dispenses ink onto the medium M and records an image on the medium M.

Figure 5C:
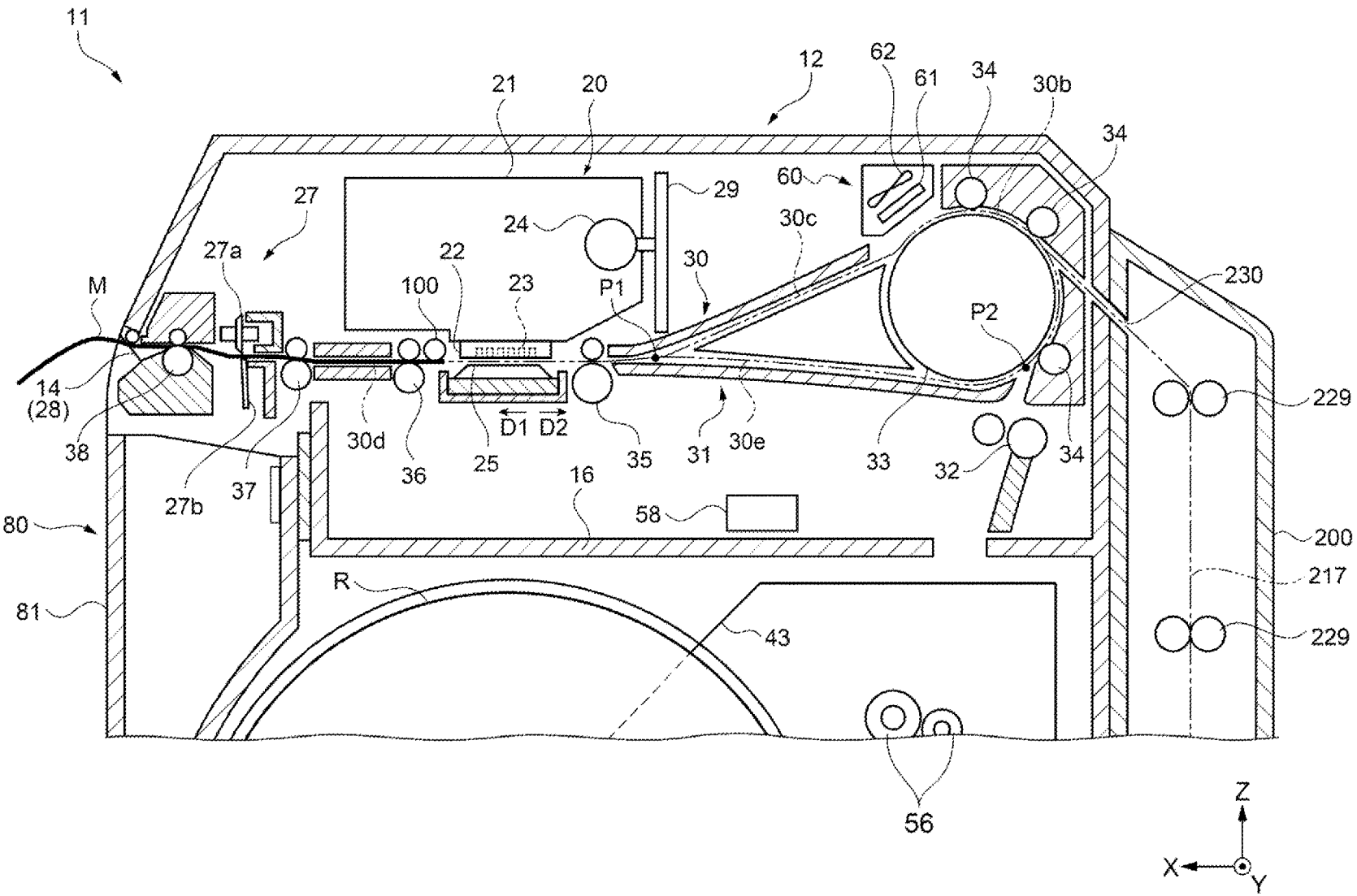
FIG. 5C is a schematic view illustrating the control method for the recording device according to the first embodiment.

Next, as illustrated in FIG. 5C, the control unit 58 transports the medium M in the progressive feeding direction Dl and stops transport of the medium M at the point when the upstream end portion of the medium M is positioned at the downstream first transport roller pair 36.

Figure 5D:
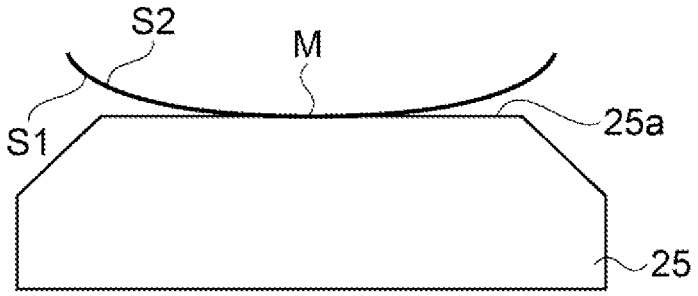
FIG. 5D is a schematic view illustrating the control method for the recording device according to the first embodiment.

Next, as illustrated in FIG. 5D, the control unit 58 drives the transport unit 31 to rotate in reverse and transports the medium M in the reverse feeding direction D2 of the transport path 30. The medium M is then drawn into the inversion path 30*e*.

Figure 5E:
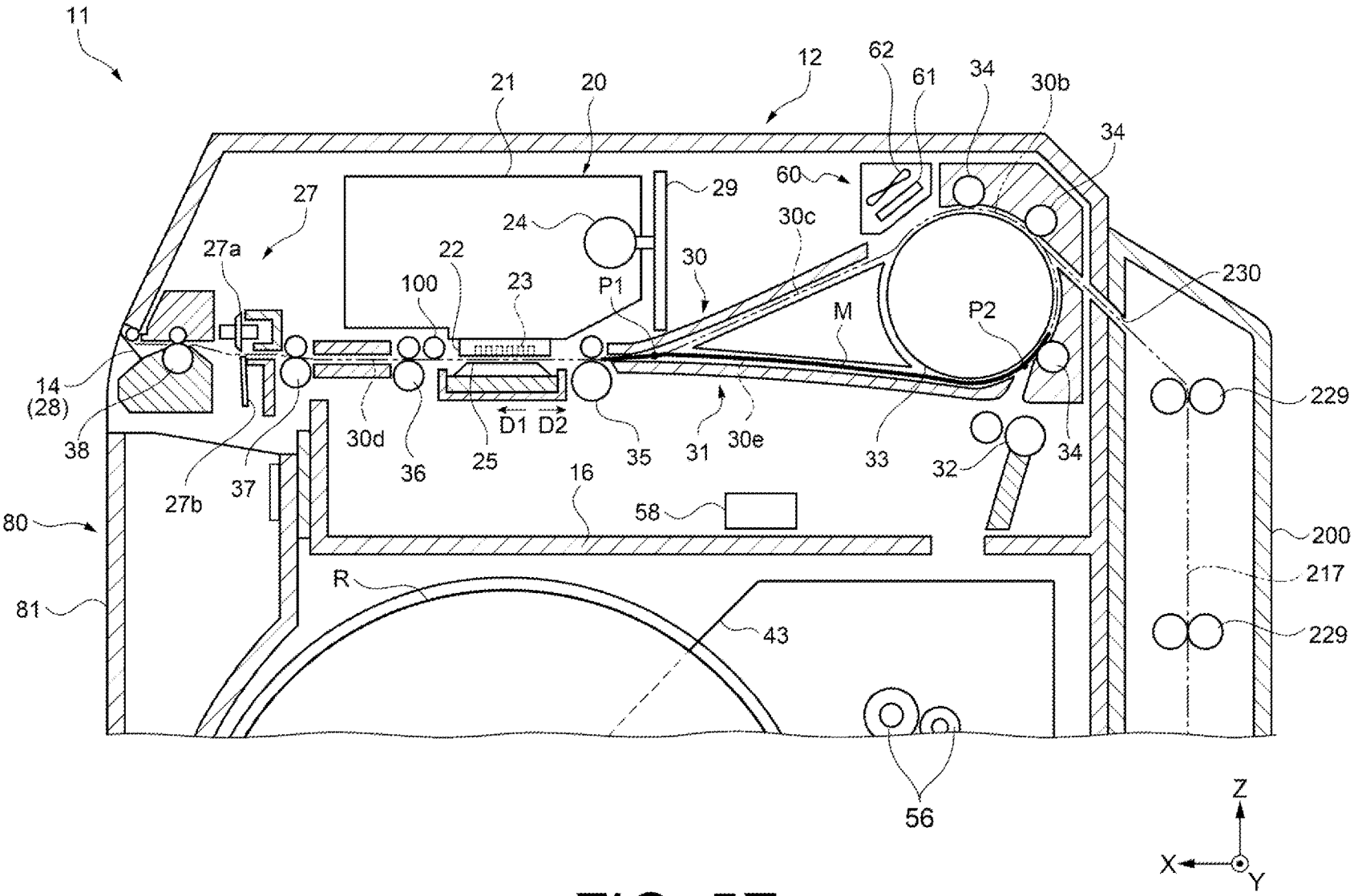
FIG. 5E is a schematic view illustrating the control method for the recording device according to the first embodiment.

Next, as illustrated in FIG. 5E, the control unit 58 drives the transport unit 31 to rotate forward and transports the medium M via the curved path 30*b* and the second path 30*c* toward the head 22. Accordingly, the medium M is inverted and the second surface S2 of the medium M faces the head 22.

Next, while the medium M is transported in the progressive feeding direction D1, ink is dispensed onto the second surface S2 of the medium M and the image is recorded. Accordingly, recording is performed on the first surface S1 and the second surface S2 of the medium M. In other words, double-sided printing is performed.

Thereafter, when the medium M is further transported in the progressive feeding direction D1, the medium M is discharged from the discharge unit 28.

Here, contact between the medium M and the head 22 will be described.

For example, in a case where the medium M used in the printing is photograph paper or the like having greater rigidity (higher rigidity) than ordinary paper, when ink is applied to the first surface S1 of the medium M, the medium M swells and deforms due to moisture in the ink. Specifically, the medium M becomes curved in a shape that is convex toward the head 22. In addition, photograph paper or the like has greater rigidity and therefore holds the curved, convex shape while being transported.

Figure 6:
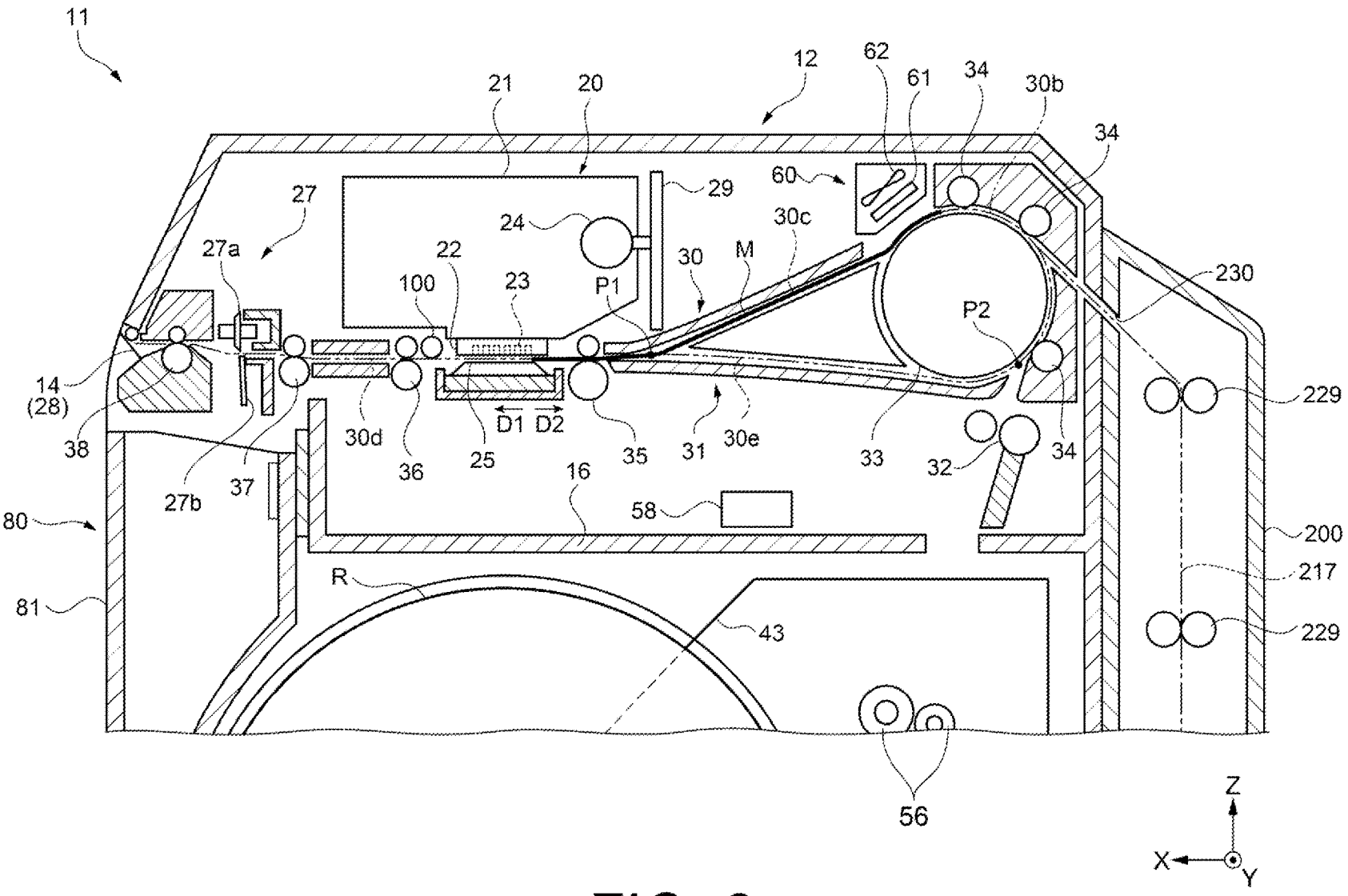
FIG. 6 is a schematic view illustrating a deformed state of a medium according to the first embodiment.

Subsequently, when the medium M is inverted front-to-back for double-sided printing and the second surface S2 faces the head 22, as illustrated in FIG. 6, the medium M is supported by the support face 25*a* in a state where the medium M is curved in a downwardly convex shape. Therefore, a transport direction end portion of the medium M will make contact with the head 22. In particular, when printing on the second surface S2, the upstream end portion of the medium M frequently escapes from a nip point, which is a position where the upstream transport roller pair 35 holds the medium M between the rollers, after which the upstream end portion of the medium M makes contact with the head 22 due to the pendulum effect.

When the medium M makes contact with and rubs against the head 22 in this way, ink adheres to the medium M and image quality degrades.

Therefore, in the embodiment, contact and rubbing of the medium M against the head 22 is inhibited by the regulating member 100.

Hereafter, a detailed configuration of the regulating member 100 will be described.

Figure 7:
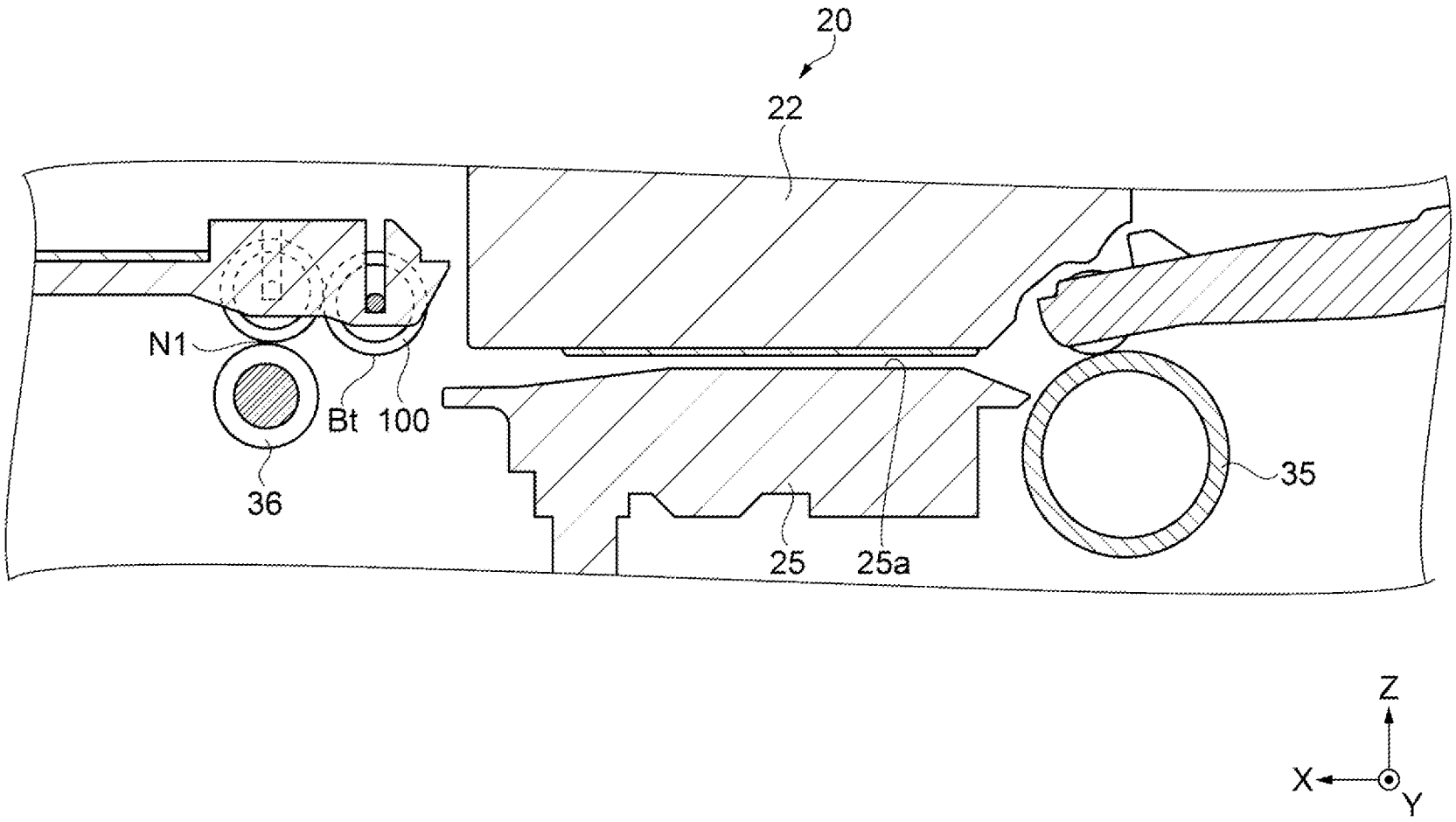
FIG. 7 is a partial enlarged view illustrating the internal configuration of the recording device according to the first embodiment.

As illustrated in FIG. 7, the downstream first transport roller pair 36 is disposed downstream of the head 22 (recording unit 20) in the transport direction of the medium M and the regulating member 100 is disposed between the head 22 and the downstream first transport roller pair 36.

A nip point N1 of the downstream first transport roller pair 36 is positioned higher than the support face 25*a* of the support unit 25 and a bottom end Bt of the regulating member 100 is disposed at a position lower than the nip point N1 of the downstream first transport roller pair 36, pushing the medium M downward. Note that the height of the bottom end Bt of the regulating member 100 is between the height of the support face 25*a* and the height of the nip point N1 of the downstream first transport roller pair 36.

Figure 8:
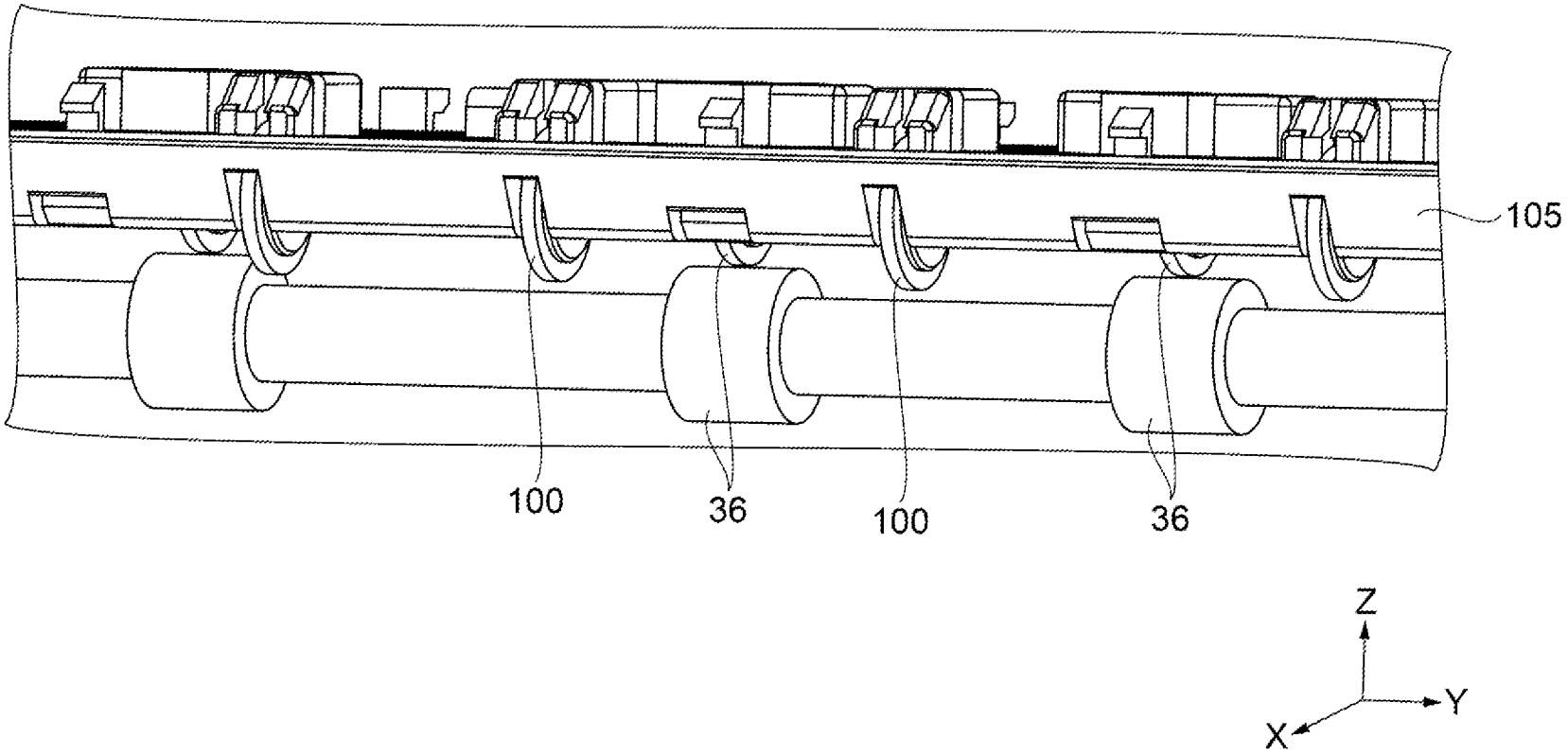
FIG. 8 is a partial perspective view illustrating a configuration in an area around a regulating member according to the first embodiment.
Figure 9:
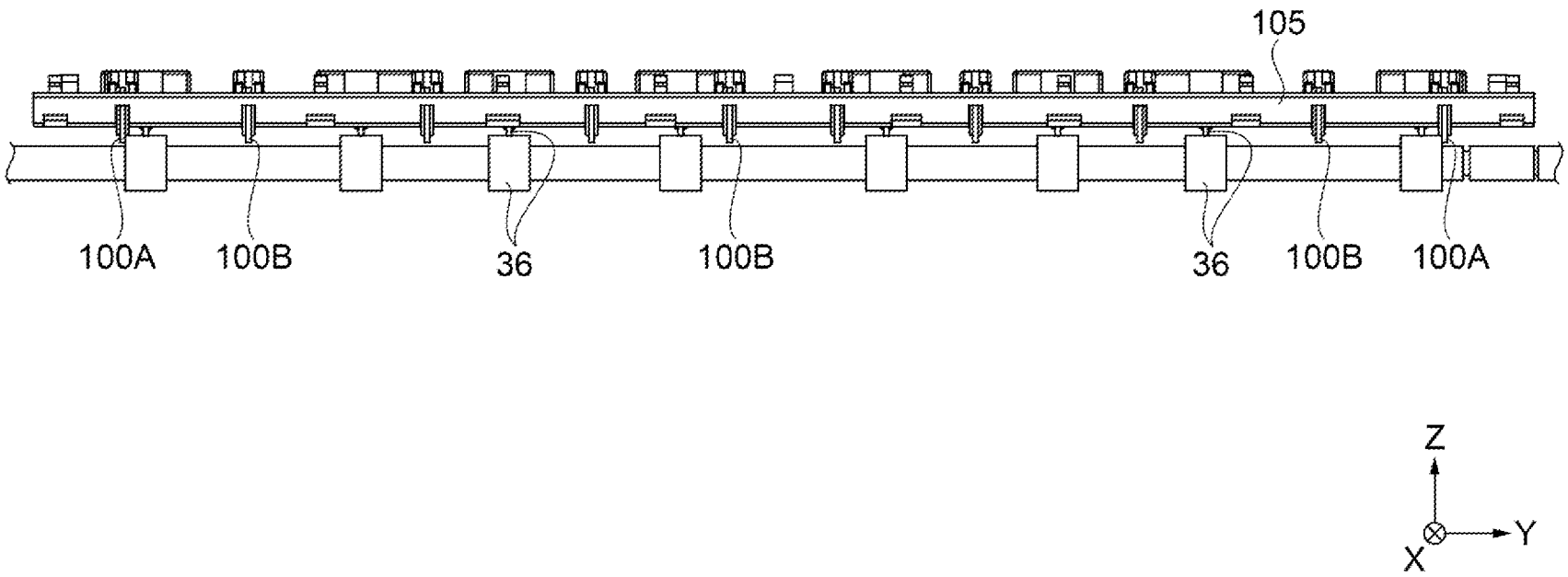
FIG. 9 is a front view illustrating the configuration in the area around the regulating member according to the first embodiment.

As illustrated in FIG. 8 and FIG. 9, a plurality of downstream first transport roller pairs 36 are disposed along the width direction (direction along the Y axis) of the medium M. In addition, a plurality of regulating members 100 are similarly disposed along the width direction of the medium M. In the embodiment, each of the regulating members 100 are disposed in the width direction between each of the downstream first transport roller pairs 36 disposed in plurality.

In addition, the regulating member 100 according to the embodiment is a rotating body, for example a rubber roller, that is driven in association with transport of the medium M. The regulating member 100 is formed to be thin. Accordingly, it is possible to decrease the surface area over which the regulating member 100 rubs against a recording surface where recording is performed on the medium M and image quality can be ensured.

Figure 10:
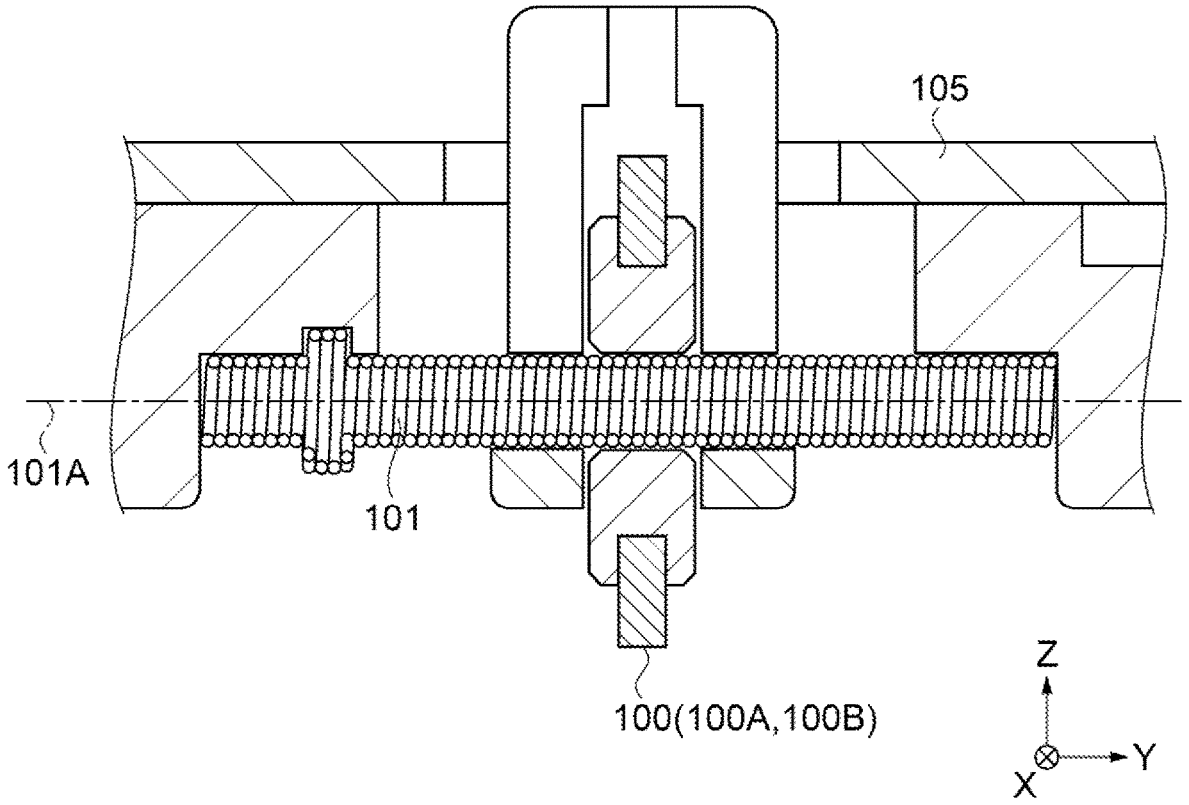
FIG. 10 is a partial cross-sectional view of the regulating member according to the first embodiment.

As illustrated in FIG. 10, the regulating member 100 rotates centered about a spring shaft 101 (axial center 101A) configured by a compressed spring as a rotary shaft. An upper portion of the regulating member 100 is covered by a folder 105. The folder 105 is supported by the body frame 16. The spring shaft 101 is supported by the folder 105. Accordingly, when the regulating member 100 presses against the medium M, for example, the medium M is pressed downward and the spring shaft 101 is deformed to be convex in the +Z direction.

Note that the regulating member 100 may be a star wheel having protrusions formed on an outer circumferential edge at a fixed angle pitch.

Also, of the plurality of regulating members 100, regulating members 100A disposed at both end portion sides in the width direction are set so as to apply less of a load on the medium M than a regulating member 100B disposed toward a center in the width direction. Note that in the embodiment, as illustrated in FIG. 9, one regulating member 100A is disposed at each of the two end portions.

The spring constant of the spring shafts 101 of the regulating members 100A disposed at the two end portions is lower than the spring constant of the spring shaft 101 of the regulating member 100B disposed toward the center. Accordingly, it is possible to configure the load applied on the medium M by the regulating members 100A disposed at both end portion sides in the width direction to be less (smaller) than the load applied on the medium M by the regulating member 100B disposed toward the center.

According to the embodiment, in double-sided printing of the medium M, even when the medium M is supported by the support face 25*a* in a state where the medium M is curved in a downwardly convex shape as illustrated in FIG. 6, the regulating member 100 regulates the medium M to be lower than the nip point N1 of the downstream first transport roller pair 36, and therefore the medium M can easily be guided to the downstream first transport roller pair 36.

In addition, when the regulating member 100 touches the medium M from above, the regulating member 100 will apply a certain degree of load to the medium M. However, when the regulating member 100 presses the medium M down excessively, a portion of the medium M touching the support face 25*a* acts as a pivot and the upstream end portion of the medium M is more likely to shift further upward and make contact with the head 22 due to the pendulum effect.

In addition, an amount of warping at the end portions in the width direction of the medium M tends to be greater than for other portions. Therefore, when the plurality of regulating members 100 press against the downstream end portion of the medium M uniformly, a high load is applied to the end portions in the width direction of the medium M and the downstream end portion of the medium M will be pushed downward more than necessary and the upstream end portion of the medium M will shift upward greatly, becoming more likely to make contact with the head 22 (recording unit 20).

Given this, of the plurality of regulating members 100, configuring the regulating members 100A disposed at both end portion sides in the width direction to apply less load on the medium M than the load applied on the medium M by the regulating member 100B disposed toward the center ensures a balanced posture of the medium M on the support face 25*a* and inhibits upward displacement of the upstream end portion of the medium M.

Thus, contact and rubbing of the medium M against the head 22 can be lessened. Accordingly, the image quality of the image recorded on the medium M can be ensured.

2. Second Embodiment

Next, a second embodiment will be described. Specifically, a configuration of a regulating unit 110 in a recording device 11A will be described. Note that configurations identical to those in the first embodiment will be denoted by the same reference signs and redundant descriptions will be omitted.

The recording device 11A includes, for example, the recording unit 20, the support unit 25, the downstream first transport roller pair 36, the transport path 30 having the inversion path 30*e* and the regulating unit 110 having the regulating member 100.

The regulating unit 110 is configured such that an amount by which the regulating members 100A disposed at both end portion sides press downward on the medium M is less than the amount by which the regulating member 100B disposed toward the center presses downward on the medium M.

Figure 11:
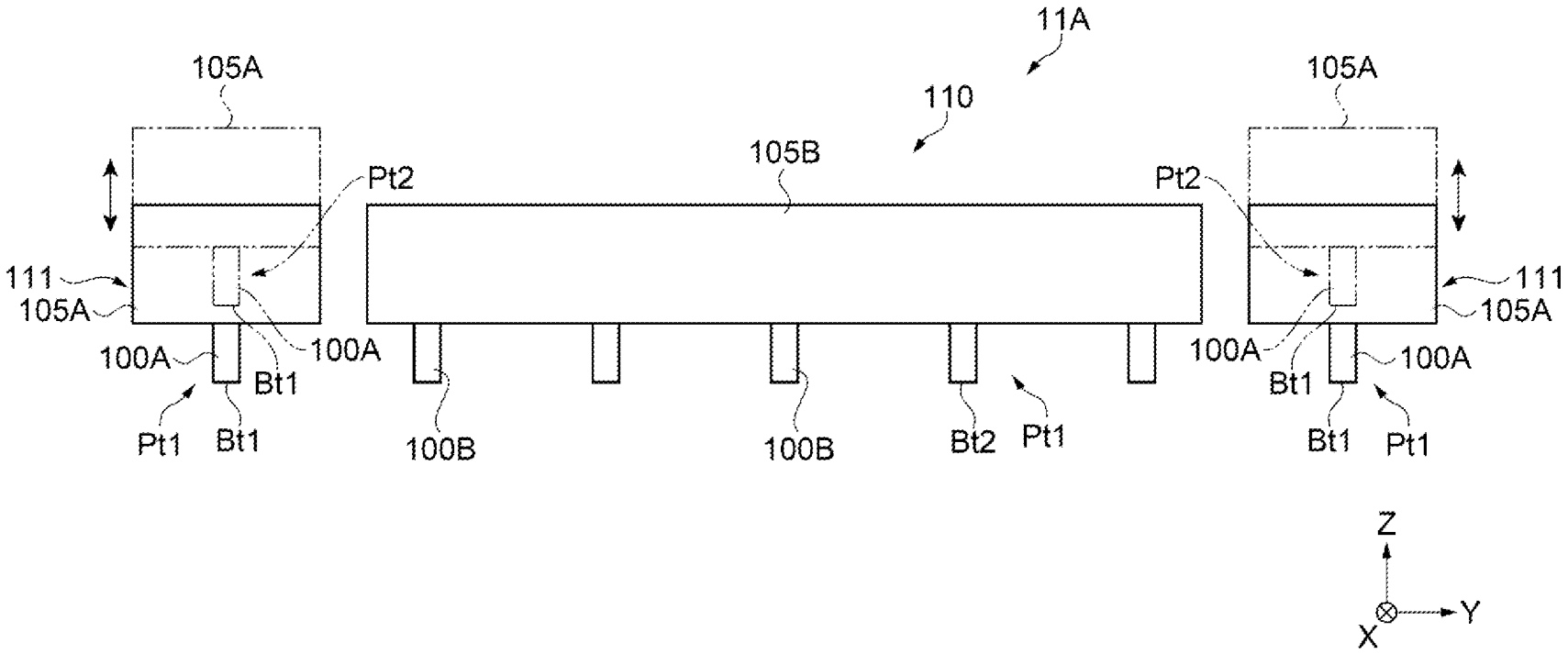
FIG. 11 is a schematic view illustrating a configuration of a recording device according to a second embodiment.

As illustrated in FIG. 11, the regulating unit 110 is configured with the regulating members 100A disposed at both end portion sides and the regulating member 100B disposed toward the center independent of each other. Specifically, the regulating members 100A disposed at both end portion sides are each supported by a first folder 105A and the regulating member 100B disposed toward the center is supported by a second folder 105B. Note that in the embodiment, the spring shafts 101 of the regulating members 100A and 100B have identical spring constants.

In addition, in the embodiment, each of the first folders 105A supports one regulating member 100A.

The second folder 105B is supported by the body frame 16. The first folder 105A is supported by the body frame 16 so as to be movable vertically. Therefore, a bottom end Bt2 of the regulating member 100B is held at a first position Pt1. On the other hand, a bottom end Bt1 of the regulating member 100A is movable to the first position Pt1 and a second position Pt2 that is higher than the first position Pt1. Note that the bottom end Bt1 of the regulating member 100A at the second position Pt2 is lower than the nip point N1 of the downstream first transport roller pair 36.

In addition, when the bottom end Bt1 of the regulating member 100A is moved to the second position Pt2, the amount by which the regulating member 100A presses downward on the medium M can be configured to be less than the amount by which the regulating member 100B presses downward on the medium M. Accordingly, it is possible to configure the load applied on the medium M by the regulating members 100A disposed at both end portion sides to be less than the load applied on the medium M by the regulating member 100B disposed toward the center.

Also, the recording device 11A includes a position adjustment mechanism 111 that changes a position in a vertical direction of the first folder 105A that supports the regulating member 100A. When the position adjustment mechanism 111 is driven, the position of the first folder 105A is changed in the vertical direction and the position of the bottom end Bt1 of the regulating member 100A can be moved between the first position Pt1 and the second position Pt2. The position adjustment mechanism 111 includes a cam mechanism, and can change the position of the first folder 105A in the vertical direction using the cam mechanism. Note that the position adjustment mechanism 111 may include a solenoid.

Figure 12:
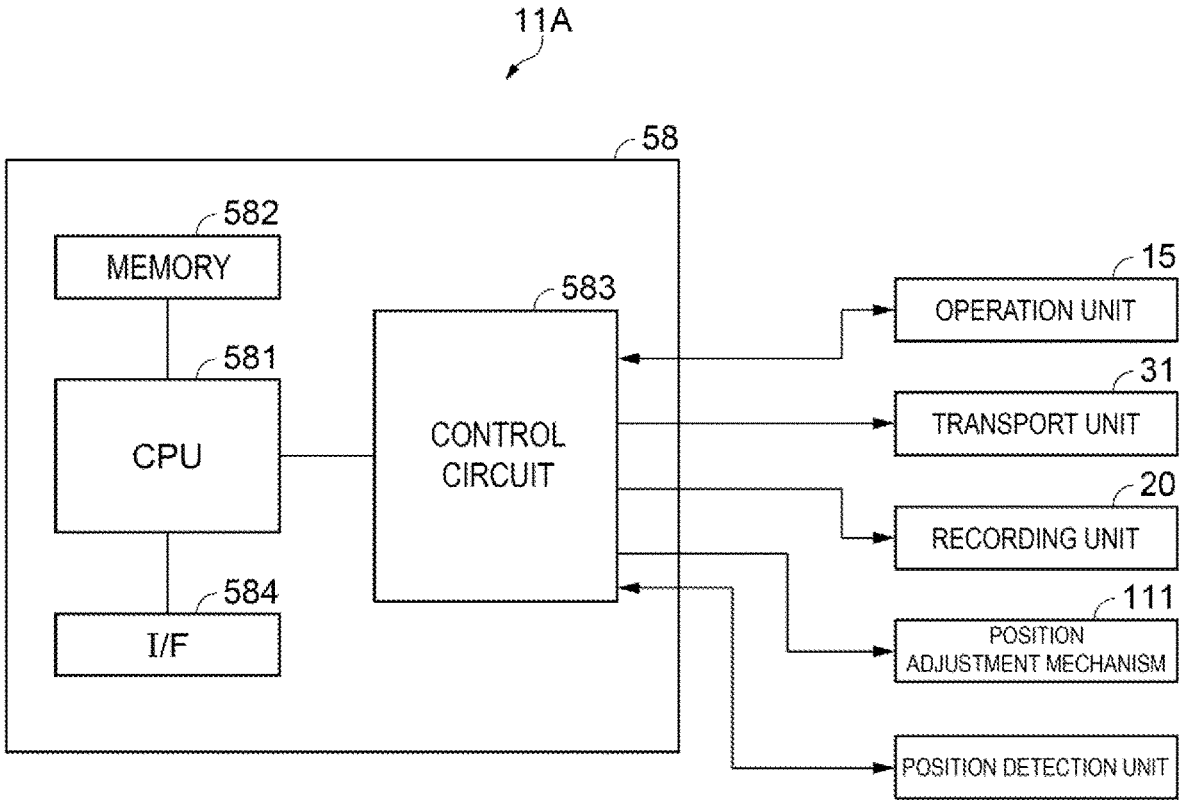
FIG. 12 is a block diagram illustrating a configuration of a control unit of the recording device according to the second embodiment.

As illustrated in FIG. 12, the recording device 11A includes the control unit 58 controlling various operations performed by the recording device 11A. The control unit 58 includes a CPU 581, a memory 582, a control circuit 583 and an interface (I/F) 584. The control unit 58 drive controls various parts and mechanisms.

The control unit 58 drive controls the position adjustment mechanism 111 and causes the regulating members 100A disposed at both end portion sides in the width direction, of the regulating members 100A and 100B, to apply less load on the medium M than the regulating member 100B disposed toward the center in the width direction.

In the embodiment, the second surface S2 is the reverse face of the medium M, and when recording is performed on the second surface S2 during double-sided printing, the position in the vertical direction for the regulating members 100A at both end portion sides is changed. Specifically, the control unit 58 moves the first folder 105A in the +Z direction. Accordingly, the position of the bottom end Bt1 of the regulating member 100A moves to the second position Pt2. In other words, the position of the bottom end Bt1 of the regulating member 100A is positioned higher than the position of the bottom end Bt2 of the regulating member 100B. Therefore, the amount by which the regulating member 100A presses on the medium M lessens and the load from the regulating member 100A on the medium M lessens.

Here, when recording is performed on the second surface S2, the control unit 58 changes the position in the vertical direction of the regulating member 100A before the nipping of the upstream end in the transport direction of the medium M by the upstream transport roller pair 35 ends. Specifically, the position of the bottom end Bt1 of the regulating member 100A is moved from the first position Pt1 to the second position Pt2 before the nipping of the upstream end in the transport direction of the medium M by the upstream transport roller pair 35 ends. Accordingly, the load applied on the medium M by the regulating member 100A at a necessary juncture can be reliably lessened.

Note that the juncture at which the nipping in the upstream transport roller pair 35 ends is detected by a position detection unit.

In addition, after the upstream end in the transport direction of the medium M passes the head 22, the control unit 58 moves the position of the bottom end Bt1 of the regulating member 100A from the second position Pt2 to the first position Pt1.

Also, when recording is performed on the second surface S2, the control unit 58 may change the position in the vertical direction of the regulating member 100A when determining that the nipping of the upstream end in the transport direction of the medium M by the upstream transport roller pair 35 ended. In other words, when the nipping of the upstream end in the transport direction of the medium M in the upstream transport roller pair 35 is determined to have ended, the position of the bottom end Bt1 of the regulating member 100A is moved from the first position Pt1 to the second position Pt2. This also allows the load applied on the medium M by the regulating member 100A to be reliably lessened. Note that after the upstream end in the transport direction of the medium M passes the head 22, the control unit 58 moves the position of the bottom end Bt1 of the regulating member 100A from the second position Pt2 to the first position Pt1.

The present embodiment can achieve a similar effect to the first embodiment.

In addition, spring shafts 101 having the same spring constant can be used in the regulating members 100A and the regulating member 100B, and therefore misassembly can be prevented and man-hours for the operation can be reduced.

3. Third Embodiment

Next, a third embodiment will be described. Specifically, double-sided printing on a long medium M will be described.

In the embodiments described above, modes were described where a cut-sheet medium M deformed into a curved shape, but similar deformation occurs in a long medium M, as well.

Specifically, as illustrated in FIG. 3, the medium M is wound into a roll. Therefore, curving deformation occurs due to curl memory.

More specifically, after recording is performed on the first surface S1 of the medium M while the medium M is still long, the medium M on which recording was performed is cut by the cutting unit 27, forming the cut-sheet medium M. Curl memory is then dramatically expressed and the medium M deforms in a curved shape. At this point, when the first surface S1 is turned upward, the medium M curves in an upwardly convex shape. Then, when the medium M that is formed as a cut sheet is inverted front-to-back and recording is performed on the second surface S2 of the medium M, the medium M curves in a downwardly convex shape and therefore the transport-direction end portion of the medium M makes contact with the head 22. Note that the first surface S1 of the medium M is an outer surface when the medium M is wound in a roll. On the other hand, a second surface S2 of the medium M is an inner surface when the medium M is wound in a roll.

Therefore, in the present embodiment, contact and rubbing of the medium M against the head 22 is inhibited by the regulating member 100.

Hereafter, a double-sided printing method for the long medium M in the recording device 11 will be described.

Figure 13A:
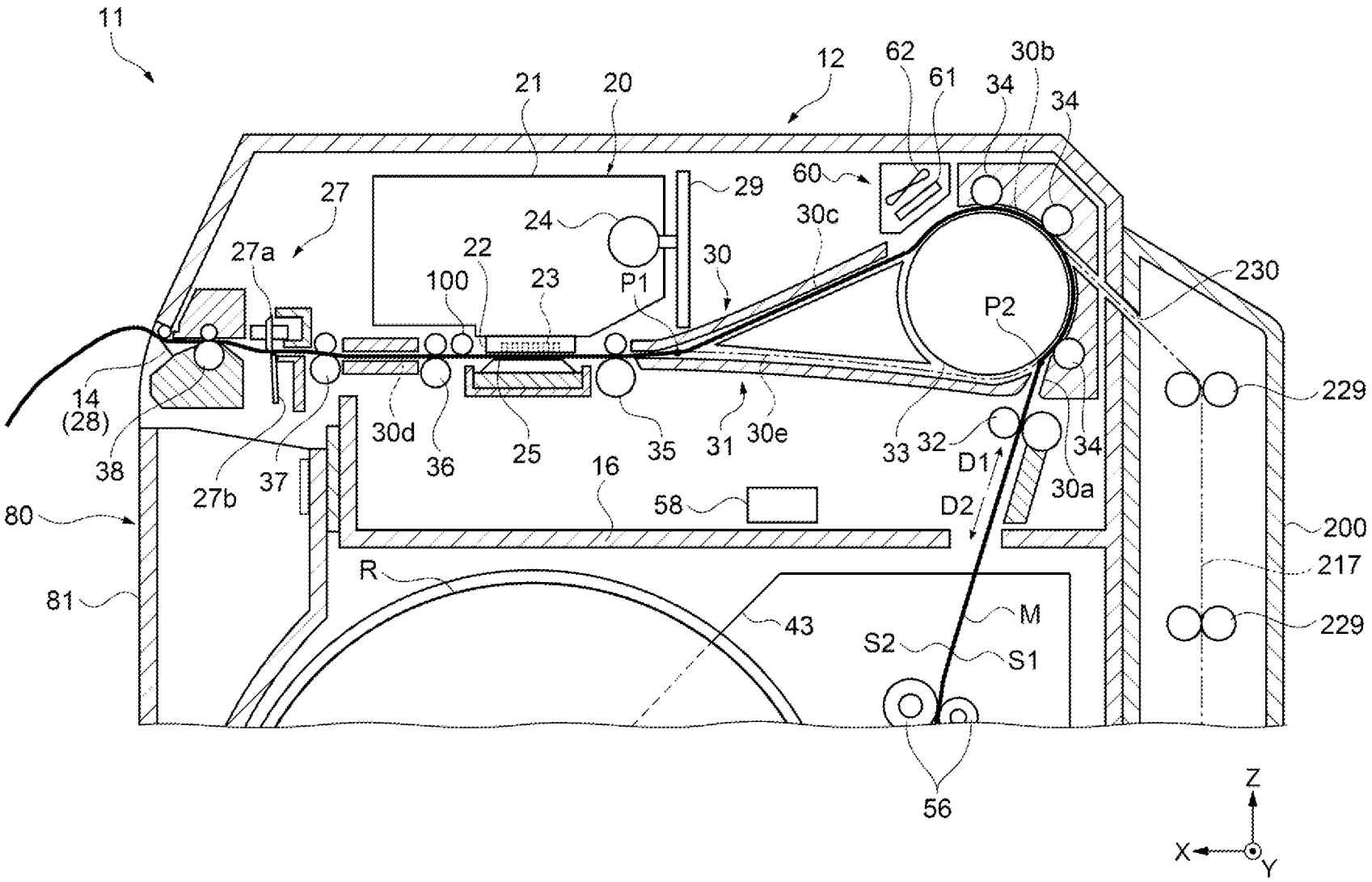
FIG. 13A is a schematic view illustrating a recording method for a recording device according to a third embodiment.

First, as illustrated in FIG. 13A, the support shaft 41 of the storage unit 40 and the transport unit 31 are driven to rotate forward and the medium M stored in the storage unit 40 is transported in the progressive feeding direction Dl of the transport path 30. The medium M is transported through the roll paper transport track 50, the first path 30*a*, the curved path 30*b* and the second path 30*c* toward the head 22. The transport unit 31 and the recording unit 20 are then driven and an image is recorded on the first surface S1 of the medium M while transporting the medium M in the progressive feeding direction D1 of the transport path 30.

Figure 13B:
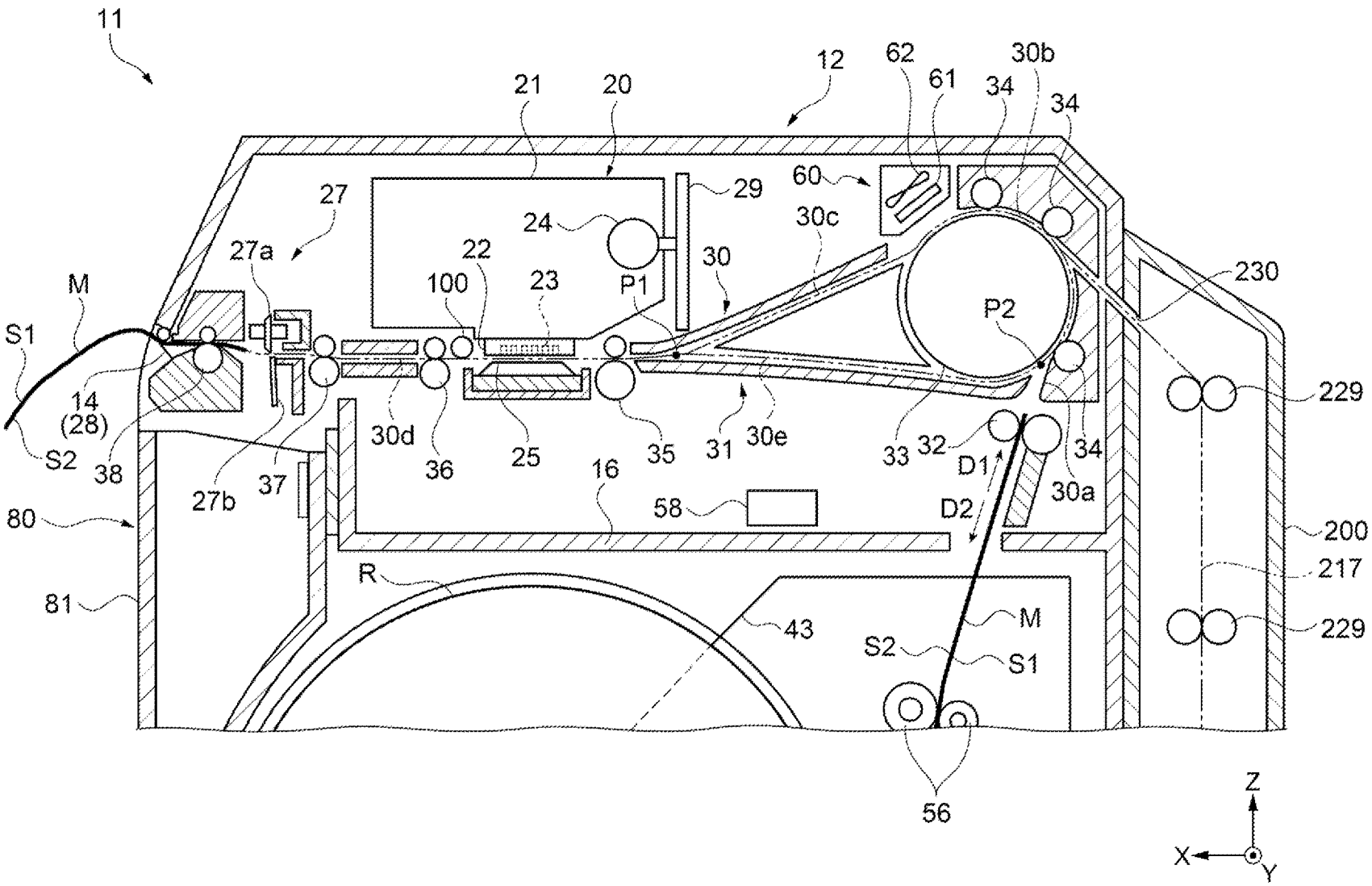
FIG. 13B is a schematic view illustrating the recording method for the recording device according to the third embodiment.

Next, as illustrated in FIG. 13B, at a predetermined juncture, the cutting unit 27 is driven and cuts the medium M. In addition, driving of the downstream third transport roller pair 38 is stopped and the medium M that has been cut into a cut sheet is held.

Furthermore, the roll paper transport roller pair 56, the feed roller pair 32, the middle roller 33, the upstream transport roller pair 35, the downstream first transport roller pair 36 and the downstream second transport roller pair 37 are driven to rotate in reverse and the medium M is transported in the reverse feeding direction D2 of the transport path 30. Then, the driving is stopped at a position where the leading edge of the medium M is held in the feed roller pair 32.

Figure 13C:
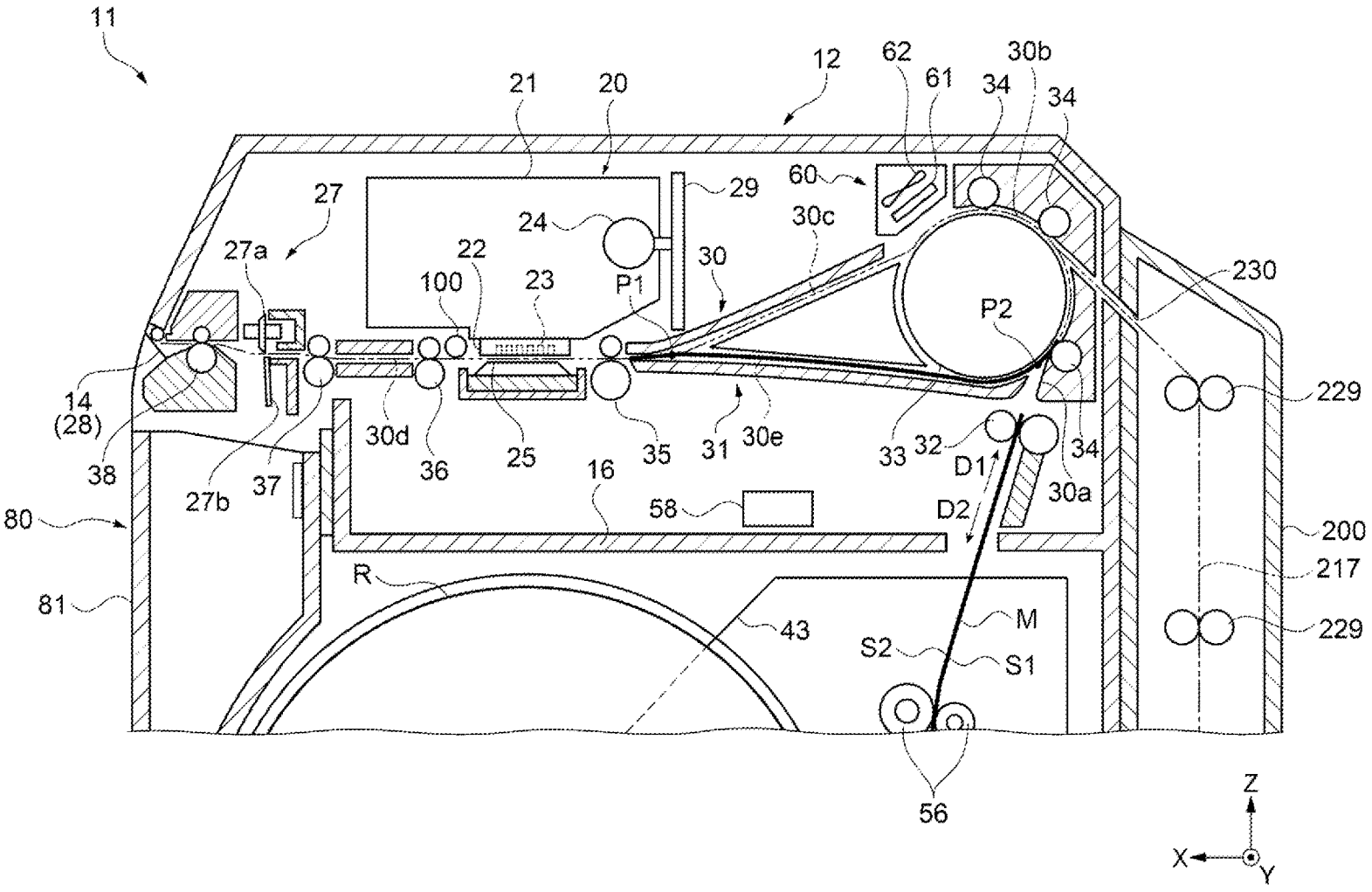
FIG. 13C is a schematic view illustrating the recording method for the recording device according to the third embodiment.

Next, as illustrated in FIG. 13C, in addition to the downstream third transport roller pair 38 being driven to rotate in reverse, the upstream transport roller pair 35, the downstream first transport roller pair 36 and the downstream second transport roller pair 37 are driven to rotate in reverse, the medium M is transported in the reverse feeding direction D2 of the transport path 30 and the cut-sheet medium M is drawn into the inversion path 30*e*.

Figure 13D:
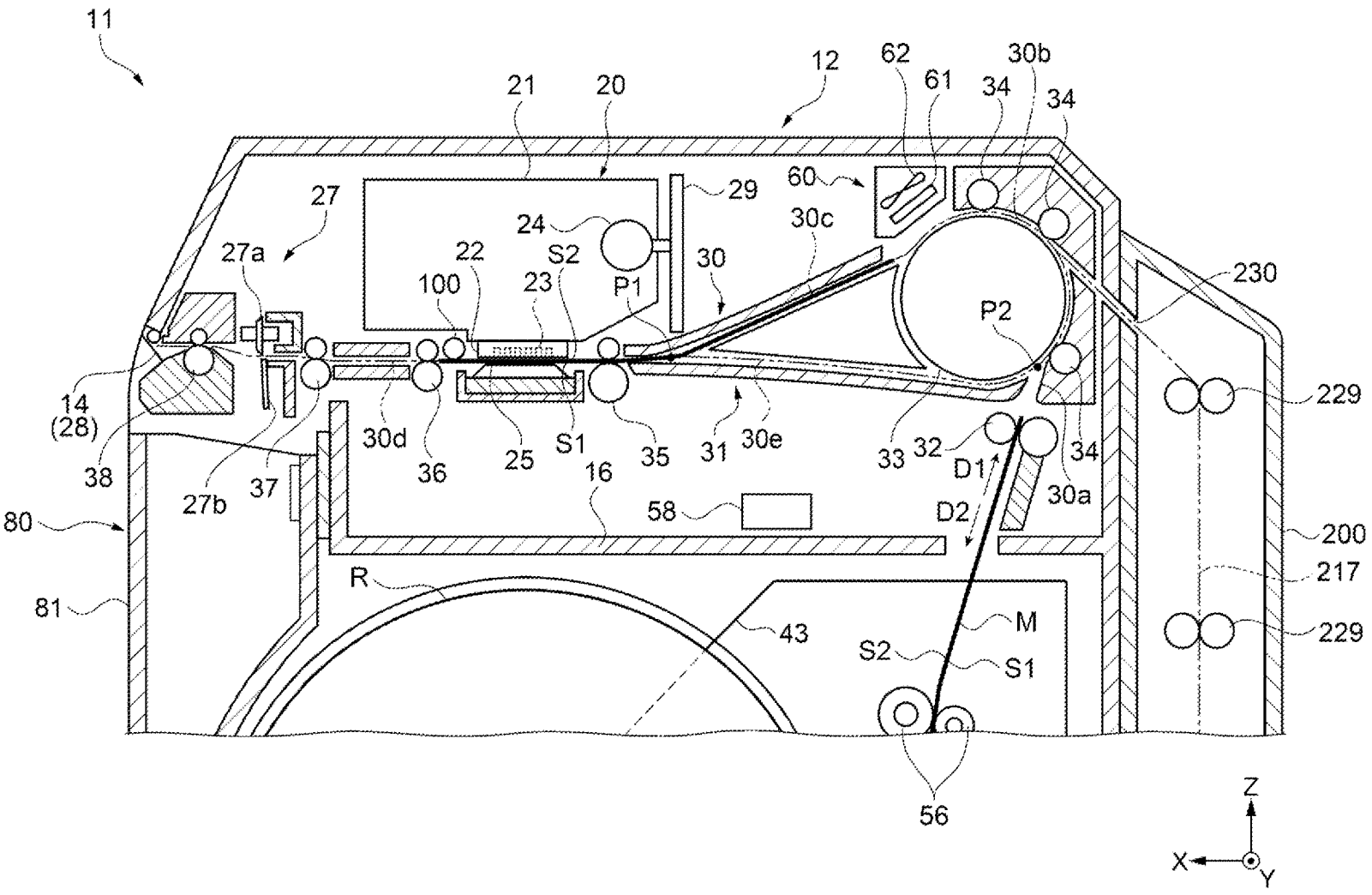
FIG. 13D is a schematic view illustrating the recording method for the recording device according to the third embodiment.

Next, as illustrated in FIG. 13D, the middle roller 33 and the upstream transport roller pair 35 are driven to rotate forward and the medium M is transported via the curved path 30*b* and the second path 30*c* toward the head 22. Accordingly, the medium M is inverted and the second surface S2 of the medium M faces the head 22. At this point, the medium M is supported by the support face 25*a* in a state where the medium M is curved in a downwardly convex shape. Therefore, similarly to the embodiments described above, of the plurality of regulating members 100, the regulating members 100A disposed at both end portion sides in the width direction can be configured to apply less load on the medium M than the load applied on the medium M by the regulating member 100B disposed toward the center. Accordingly, even when there is curl memory due to winding into a roll, the medium M is pressed by the regulating members 100A and 100B and contact of the medium M against the head 22 can be inhibited.

Next, while the medium M is transported in the progressive feeding direction D1, ink is dispensed onto the second surface S2 of the medium M and the image is recorded. Accordingly, recording is performed on the first surface S1 and the second surface S2 of the medium M. In other words, double-sided printing is performed.

Thereafter, when the medium M is further transported in the progressive feeding direction D1, the medium M is discharged from the discharge unit 28.

Note that in the embodiments described above, the regulating member 100 is a rotating body. However, the disclosure is not limited to this. For example, the regulating member 100 may be a rib or the like. Even with this configuration, similar advantages as described above can be obtained.

What is claimed is:

1. A recording device comprising:

a recording unit configured to dispense a liquid onto a medium to perform recording;

a support unit disposed facing the recording unit and configured to support the medium at a support face;

a downstream transport roller pair disposed in plurality along a width direction intersecting a transport direction of the medium and downstream of the recording unit in the transport direction of the medium and configured to transport the medium;

a regulating member disposed in plurality along the width direction of the medium between the recording unit and the downstream transport roller pair in the transport direction and configured to touch the medium from above; and an inversion path configured to invert front-to-back the medium on which recording was performed on a first surface of the medium and to merge upstream of the recording unit so as to achieve recording on a second surface of the medium opposite from the first surface, wherein a nip point of the downstream transport roller pair is positioned higher than the support face and a bottom end of each regulating member is disposed at a position for pushing the medium down lower than the nip point of the downstream transport roller pair, and of the plurality of regulating members, the regulating members disposed at both end portion sides in the width direction apply less load on the medium than the regulating member disposed toward a center in the width direction.

2. The recording device according to claim 1, wherein each regulating member is a rotating body driven in association with transport of the medium.

3. The recording device according to claim 2, wherein each rotating body is configured to rotate with a spring as an axis, and a spring constant of the springs of the rotating bodies disposed at both end portion sides is lower than a spring constant of the spring of the rotating body disposed toward the center.

4. The recording device according to claim 1, wherein an amount by which the regulating members disposed at both end portion sides press downward on the medium is less than the amount by which the regulating member disposed toward the center presses downward on the medium.

5. The recording device according to claim 1, wherein the regulating member is disposed, in the width direction, between each of the downstream transport roller pairs disposed in plurality in the width direction.

6. The recording device according to claim 1, wherein one regulating member is disposed at each of the two end portion sides.

7. The recording device according to claim 1 comprising:

a cutting unit disposed downstream of the downstream transport roller pair and configured to cut the medium on which recording was performed, wherein when the medium is a long medium wound in a roll shape, recording is performed on the first surface, the first surface being an outer surface when the medium is wound in a roll shape, the medium on which recording was performed on the first surface is cut by the cutting unit, the cut medium is inverted front-to-back via the inversion path, and recording is performed on the second surface, the second surface being an inner surface when the medium is wound in a roll shape.

8. The recording device according to claim 4 further comprising:

a position adjustment mechanism configured to change a position in a vertical direction of the regulating members at both end portion sides; and a control unit configured to control the position adjustment mechanism, wherein when recording is performed on the second surface, the control unit changes the position in the vertical direction of the regulating members at both end portion sides.

9. The recording device according to claim 8, comprising:

an upstream transport roller pair configured to transport the medium upstream of the recording device in the transport direction of the medium, wherein when recording is performed on the second surface, the control unit changes a position in the vertical direction of the regulating members at both end portion sides before nipping of an upstream end in the transport direction of the medium by the upstream transport roller pair ends.

10. The recording device according to claim 8, comprising:

an upstream transport roller pair configured to transport the medium upstream of the recording device in the transport direction of the medium, wherein when recording is performed on the second surface, the control unit changes a position in the vertical direction of the regulating members at both end portion sides when determining that nipping of an upstream end in the transport direction of the medium by the upstream transport roller pair ended.

11. The recording device according to claim 8, wherein the position adjustment mechanism includes a cam or solenoid.

12. A control method for a recording device comprising:

a recording unit configured to dispense a liquid onto a medium to perform recording;

a support unit disposed facing the recording unit and configured to support the medium;

a downstream transport roller pair disposed in plurality along a width direction of the medium and downstream of the recording unit in a transport direction of the medium and configured to transport the medium;

a regulating member disposed in plurality along the width direction of the medium between the recording unit and the downstream transport roller pair in the transport direction of the medium and configured to touch the medium from above;

an inversion path configured to invert front-to-back the medium on which recording was performed on a first surface of the medium and to merge upstream of the recording unit so as to achieve recording on a second surface of the medium opposite from the first surface;

a position adjustment mechanism configured to change a position in a vertical-direction of the regulating members at both end portion sides in the width direction; and a control unit, wherein the control unit controls the position adjustment mechanism and causes the regulating members disposed at both end portion sides in the width direction, of the plurality of regulating members, to apply less load on the medium than the regulating member disposed toward a center.

* * * * *